US011185149B2

(12) United States Patent
Schindfessel et al.

(10) Patent No.: US 11,185,149 B2
(45) Date of Patent: Nov. 30, 2021

(54) INFLATABLE PORTABLE LEDGE APPARATUS

(71) Applicant: Grade VII Equipment Limited, Squamish (CA)

(72) Inventors: Tom Schindfessel, Squamish (CA); Nathan Kukathas, Squamish (CA)

(73) Assignee: 0950300 B.C. Ltd., Squamish (CA)

( * ) Notice: Subject to any disclaimer, the term of this patent is extended or adjusted under 35 U.S.C. 154(b) by 3 days.

(21) Appl. No.: 16/784,143

(22) Filed: Feb. 6, 2020

(65) Prior Publication Data

US 2020/0245748 A1 Aug. 6, 2020

Related U.S. Application Data

(60) Provisional application No. 62/802,190, filed on Feb. 6, 2019.

(51) Int. Cl.

| | |
|---|---|
| ***A45F 3/24*** | (2006.01) |
| ***A45F 3/22*** | (2006.01) |
| ***A63B 29/00*** | (2006.01) |
| ***A47C 17/84*** | (2006.01) |

(52) U.S. Cl.

CPC ..... *A45F 3/24* (2013.01); *A47C 17/84* (2013.01); *A63B 29/00* (2013.01); *A45F 3/22* (2013.01)

(58) Field of Classification Search

CPC ... A45F 3/24; A45F 3/22; A63B 29/00; A47C 17/84; A47C 27/087; A47C 27/088; A47C 27/081; A47C 27/128; A61G 7/1013; A61G 7/1015; A61G 7/1021; A61G 7/10; A61G 1/013; A61G 1/00

USPC ..... 5/127, 128, 121, 120, 711, 712, 709, 5/81.1 R, 89.1, 625, 627; 182/141–144, 182/150

See application file for complete search history.

(56) References Cited

U.S. PATENT DOCUMENTS

| | | | | |
|---|---|---|---|---|
| 6,581 A * | 7/1849 | Seely | A47C 1/146 441/128 |
| 2,542,781 A * | 2/1951 | Sawyer | A47C 27/081 5/711 |
| 2,970,324 A * | 2/1961 | Phillips | B63C 9/02 441/38 |

(Continued)

FOREIGN PATENT DOCUMENTS

| | | |
|---|---|---|
| AU | 2017100530 | 7/2017 |
| CA | 2209806 | 1/1999 |

(Continued)

OTHER PUBLICATIONS

Wikipedia "Portaledge", archived page from Nov. 17, 2018.
International Search Report and Written Opinion dated May 28, 2020 from corresponding PCT/CA2020/050156.

*Primary Examiner* — Robert G Santos
(74) *Attorney, Agent, or Firm* — Nicholas Garner; Oyen Wiggs Green & Mutala LLP

(57) ABSTRACT

An inflatable portable ledge apparatus comprises an inflatable platform having a plurality of transverse baffles and a plurality of longitudinal baffles. There are a plurality of suspension straps connected to the inflatable platform. The suspension straps are connected the inflatable platform so that a load on the inflatable platform is distributed across all the suspension straps when the portable ledge apparatus is anchored at a single point.

20 Claims, 24 Drawing Sheets

(56) References Cited

U.S. PATENT DOCUMENTS 3,775,782 A * 12/1973 Rice ..... A61G 1/00 5/625
RE28,916 E * 7/1976 Rice ..... A61G 1/00 5/628
4,067,075 A * 1/1978 Leathers ..... A61G 1/00 5/625
4,092,750 A * 6/1978 Ellis ..... A47C 27/081 5/413 AM
4,466,145 A * 8/1984 Jones ..... A61G 1/00 441/40
4,526,307 A 7/1985 Parker
4,533,333 A * 8/1985 Andrew ..... B63C 9/01 441/38
4,644,597 A * 2/1987 Walker ..... A47C 27/087 5/706
4,688,283 A * 8/1987 Jacobson ..... A47C 27/081 5/709
4,736,474 A * 4/1988 Moran ..... A61G 1/007 5/627
4,788,729 A * 12/1988 Walker ..... A47C 27/081 137/557
4,825,485 A * 5/1989 Chiou ..... A47C 27/085 5/682
4,908,895 A * 3/1990 Walker ..... A47C 27/081 5/706
5,060,324 A * 10/1991 Marinberg ..... A61B 6/0442 5/81.1 T
5,115,525 A 5/1992 Lovitt
5,283,916 A * 2/1994 Haro ..... A61G 1/00 244/118.5
5,474,361 A * 12/1995 Hwang ..... A47C 1/146 297/380
5,560,056 A * 10/1996 Tai ..... A45F 3/22 297/118
5,561,873 A * 10/1996 Weedling ..... A61G 7/1028 5/703
5,673,444 A 10/1997 Middendorf
5,699,657 A * 12/1997 Paulson ..... B65H 69/06 28/142
5,860,175 A 1/1999 Saiki
5,898,960 A 5/1999 Hill
6,053,534 A * 4/2000 Timmerman ..... A62B 1/02 280/17
6,167,898 B1 1/2001 Larga
6,948,206 B1 * 9/2005 Valencia ..... A47C 27/081 5/120
6,964,073 B1 * 11/2005 Curry ..... A61G 1/00 128/870
7,051,385 B2 5/2006 Gardner
7,306,417 B2 * 12/2007 Dorstewitz ..... B60P 7/0823 410/100
8,566,977 B2 * 10/2013 Davis ..... A61G 7/1028 5/81.1 HS
8,782,833 B2 * 7/2014 Beurguet ..... A62B 31/00 5/625
9,254,446 B2 2/2016 Lacy et al.
9,347,238 B2 5/2016 Dominick
9,630,119 B2 4/2017 Fries et al.
9,861,539 B1 * 1/2018 Stickler ..... A61G 1/013
10,132,100 B1 11/2018 Akad
2003/0106155 A1 * 6/2003 Arai ..... A61G 1/00 5/627
2006/0162086 A1 7/2006 Davis
2007/0071568 A1 * 3/2007 Dorstewitz ..... B60P 7/0823 410/97
2007/0169803 A1 7/2007 Brensinger
2010/0299837 A1 * 12/2010 Yandle ..... B63B 34/00 5/627
2011/0016629 A1 1/2011 Helgeland
2012/0210511 A1 * 8/2012 Davis ..... A61G 7/1051 5/81.1 R
2012/0291203 A1 * 11/2012 Beurguet ..... A62B 1/02 5/706
2016/0107095 A1 4/2016 Fries et al.
2020/0245748 A1 * 8/2020 Schindfessel ..... A45F 3/24
2021/0093493 A1 * 4/2021 Davis ..... A61G 1/048

FOREIGN PATENT DOCUMENTS

CA 2549793 6/2005
CA 2827120 8/2012
CA 2936664 8/2015
CN 106473435 3/2017
DE 103 33 633 3/2005
WO WO2009007740 1/2009
WO WO2018132021 1/2018
WO WO2018195365 10/2018
WO WO-2020160673 A1 * 8/2020 ..... A63B 29/00

* cited by examiner

INFLATABLE PORTABLE LEDGE APPARATUS

BACKGROUND OF THE INVENTION

Field of the Invention

The present invention relates to a portable ledge apparatus and, in particular, to an inflatable portable ledge apparatus.

Description of the Related Art

U.S. Pat. No. 5,673,444 which issued on Oct. 7, 1997, to Middendorf discloses a portable ledge apparatus in the form of a suspended hammock for mountaineering. The suspended hammock is for suspending a climber adjacent a substantially vertical face of a mountain. The hammock includes a supporting membrane which forms a bed of a size to support the climber in a substantially prone position, and a T-shaped supporting frame to which the bed is attached by a plurality of suspension straps. The straps are positioned along the edges of the bed, with one strap being positioned at each side of the head end, two straps being positioned on each side in the middle, and a fourth strap being positioned on each side at the foot end of the bed. The straps can be adjusted in length by means of a buckle. The T-frame comprises a spreader bar and a cross bar, with the spreader bar being attached to the cross bar at its midpoint. The suspension straps are attached in a spaced relationship to the first and second ends of the spreader bar. The T-frame in turn is attached to the mountain face by a set of T-frame suspension straps attached to the extreme ends of the cross bar and the first end of the spreader bar. One of the T-frame suspension straps can be made adjustable in length. The use of the suspended hammock reduces thermal exchange between the climber and the mountain environment while resting.

International Patent Application Publication No. WO 2018/132021 A1 to Schulze discloses a suspendable portable shelter, suitable for use in outdoor activities such as mountain climbing, cycling, boating, or hiking. The shelter comprises an inflatable base member and a flexible outer cover configured to envelop the base member. The flexible outer cover comprises a mounting means from which the suspendable portable shelter may be suspended in use. An interior portion of the flexible outer cover is adapted to receive the inflatable base member and has a complementary shape to the inflatable base member.

SUMMARY OF THE INVENTION

There is provided a portable ledge apparatus comprising an inflatable platform having a plurality of transverse baffles and a plurality of longitudinal baffles. There are a plurality of suspension straps connected to the inflatable platform. The suspension straps are connected the inflatable platform so that a load on the inflatable platform is distributed across all the suspension straps when the portable ledge apparatus is anchored at a single point.

The portable ledge apparatus may be used as a platform to support a person standing, sitting or lying down. The portable ledge apparatus may be used as platform to carry a person like a stretcher, or suspended. The portable ledge apparatus may be used as a platform suspended from a vertical face, for example, a cliff face.

There is also provided a portable ledge apparatus according to a further aspect. The apparatus includes an inflatable platform including a plurality of baffles. The apparatus includes a plurality of suspension straps connected to the inflatable platform. The suspension straps connect to the inflatable platform so that a load on the inflatable platform is distributed across all of the suspension straps when the portable ledge apparatus is anchored at a single point.

There is further provided a portable ledge apparatus according to an additional aspect. The apparatus includes an inflatable platform having a top, a bottom, and first and second longitudinal sides extending between the top thereof and the bottom thereof. The apparatus includes a plurality of baffles coupled to and extending between the top and the bottom of the inflatable platform. This includes a first longitudinally-extending said baffle extending parallel with the first longitudinal side of the inflatable platform, a second longitudinally-extending said baffle extending parallel with the second longitudinal side of the inflatable platform, and additional said baffles extending between the longitudinal sides of the inflatable platform. The apparatus includes one or more suspension members connected to the inflatable platform.

There is yet additionally provided a height-adjustment assembly for a suspended load. The height-adjustment assembly includes a first end portion of rope. The assembly includes a second end portion of rope coupled to the first end portion of rope. The second end portion of rope includes a hollow sub-portion and a first anchor-point loop connectable to the suspended load. The assembly includes a second loop formed by extending the first end portion of rope through the hollow sub-portion of the second end portion of rope. The second loop is connectable to an elevated coupling member, with the suspended load causing the hollow sub-portion to constrict in cross-section and frictionally engage the first end portion of rope. Pulling on the first end portion of rope expands the hollow sub-portion, enabling the first end portion of rope to be further pulled through the hollow sub-portion. This reduces the size of the second loop and raises the suspended load.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figures 1, 1A:
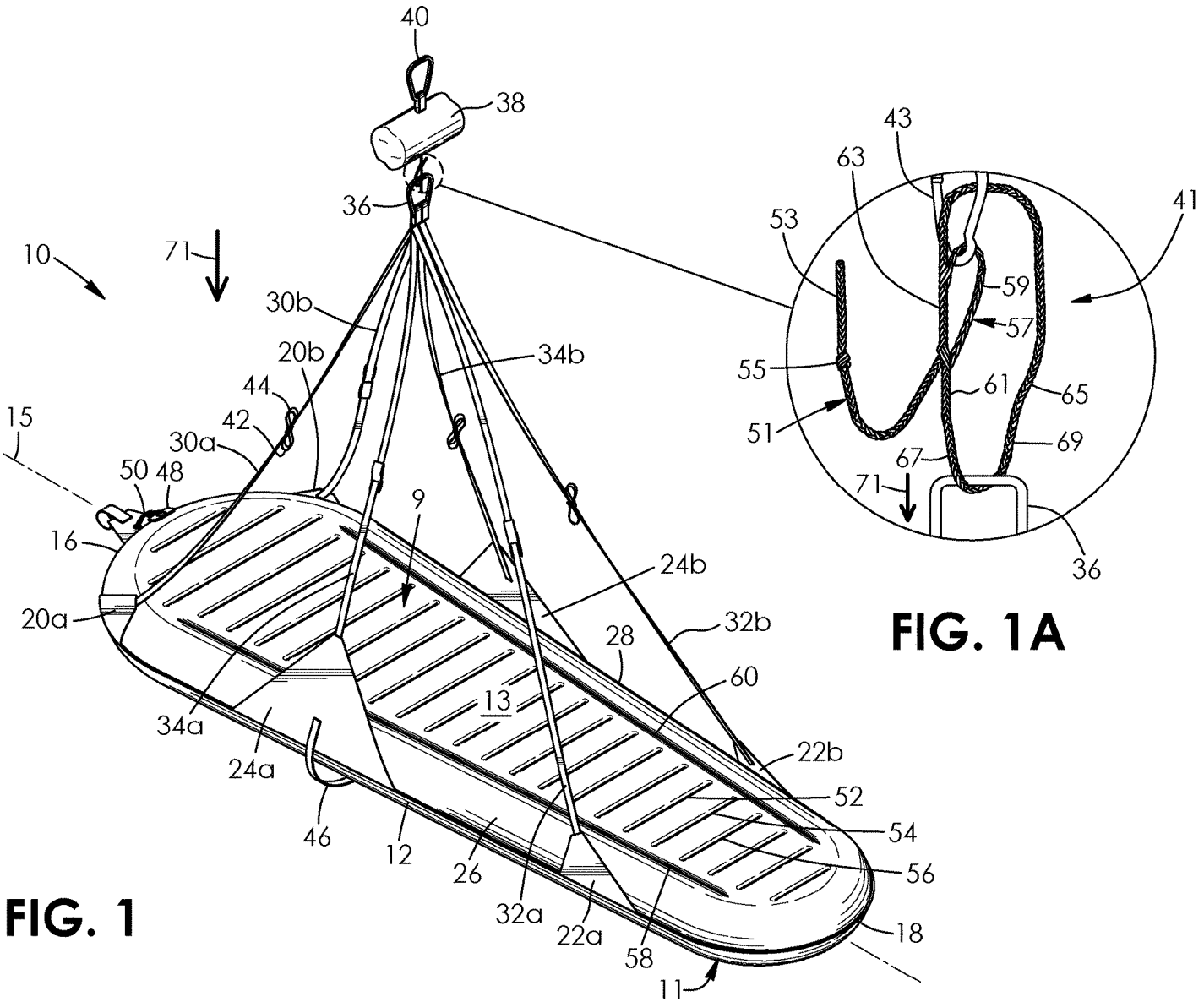
FIG. 1 is a perspective view of an inflatable portable ledge apparatus.
FIG. 1A is an enlarged view of an adjustable strap of the portable ledge apparatus of FIG. 1.
Figure 2:
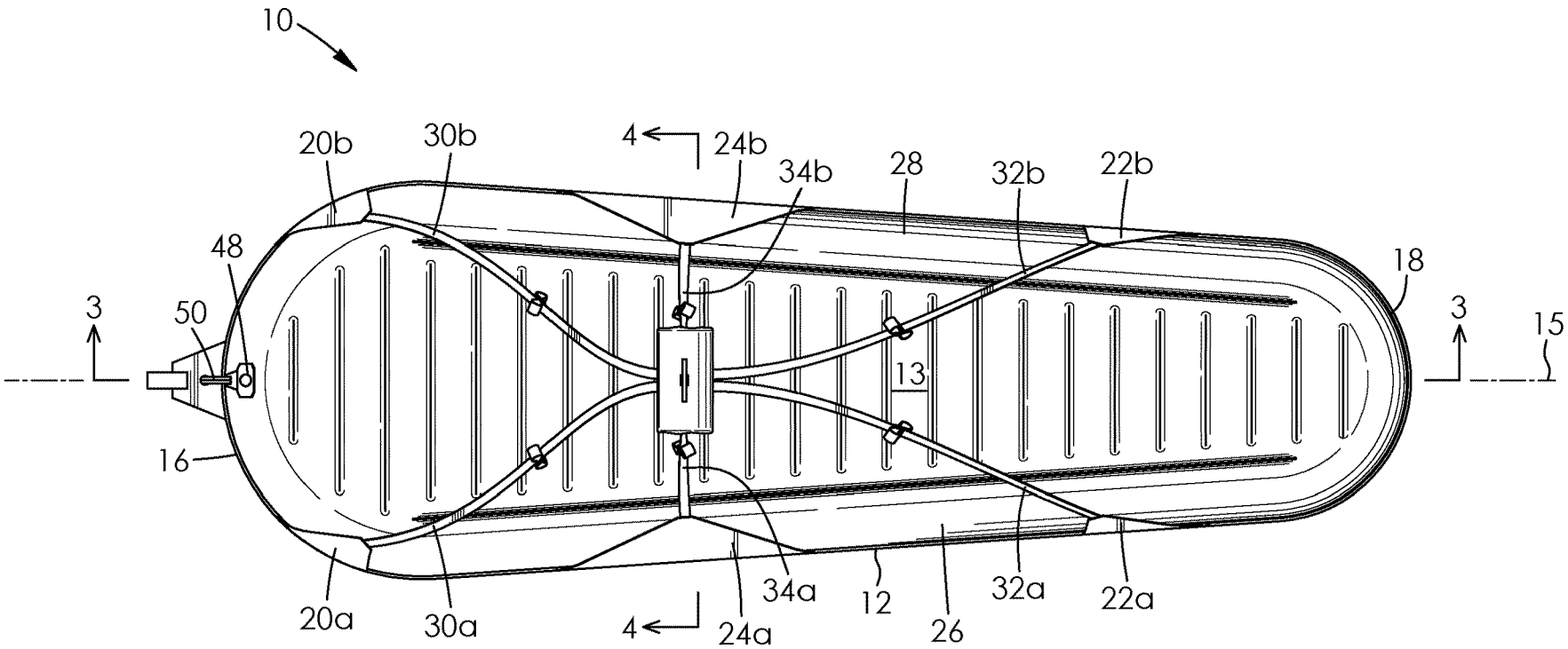
FIG. 2 is a top plan view of the portable ledge apparatus of FIG. 1.
Figure 3:
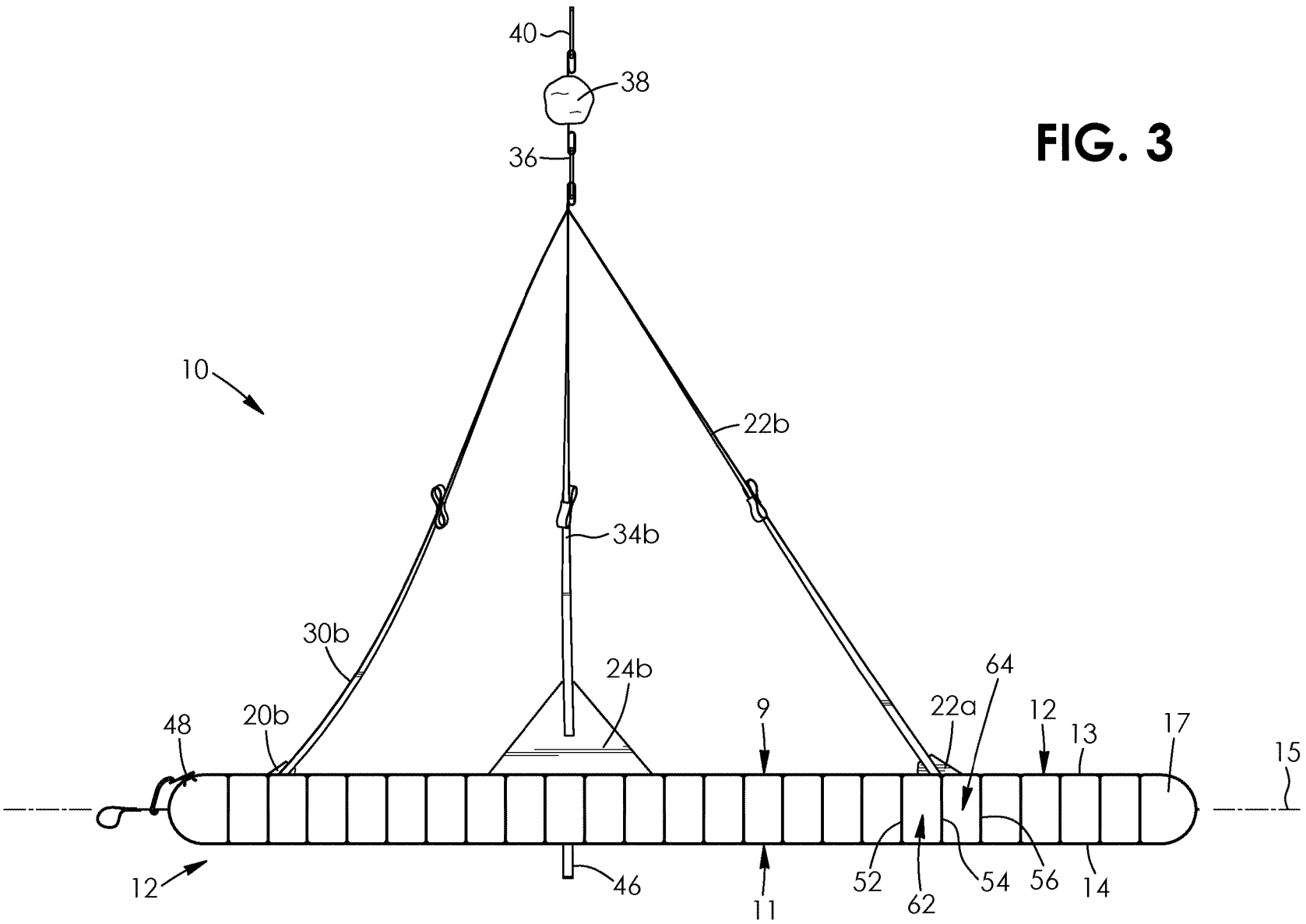
FIG. 3 is a longitudinal cross-section view of the portable ledge apparatus of FIG. 1 taken along lines 3-3 of FIG. 2.

Referring to the drawings, and first to FIGS. 1 and 2, there is shown an inflatable portable ledge apparatus 10, also known as a portaledge, which comprises an inflatable platform 12. The inflatable platform 12 has a top 9, a generally oblong and oval shaped top surface 13 extending along the top. As seen in FIG. 3, the inflatable platform has a bottom 11 and a generally oblong, oval shaped bottom surface 14 extending along the bottom. The top and bottom surfaces of the platform extend between a first end 16 of the inflatable platform 12 and a second end 18 of the inflatable platform 12 seen in FIG. 1.

Still referring to FIG. 1, the inflatable platform has a longitudinal axis 15 which extends from the first end to the second end thereof. The first end 16 of the inflatable platform 12 has a larger radius than the second end 18 of the inflatable platform 12. In this example, the inflatable platform is constructed by laminating a thermoplastic polyurethane (TPU) to a woven, non-woven or knit textile. Multiple layers of thermoplastic polyurethane are laminated to the textile. Each layer of thermoplastic polyurethane laminated to the textile may have different properties including color, hardness, melt temperature, etc. This results in improved abrasion resistance and puncture resistance.

Figure 6:
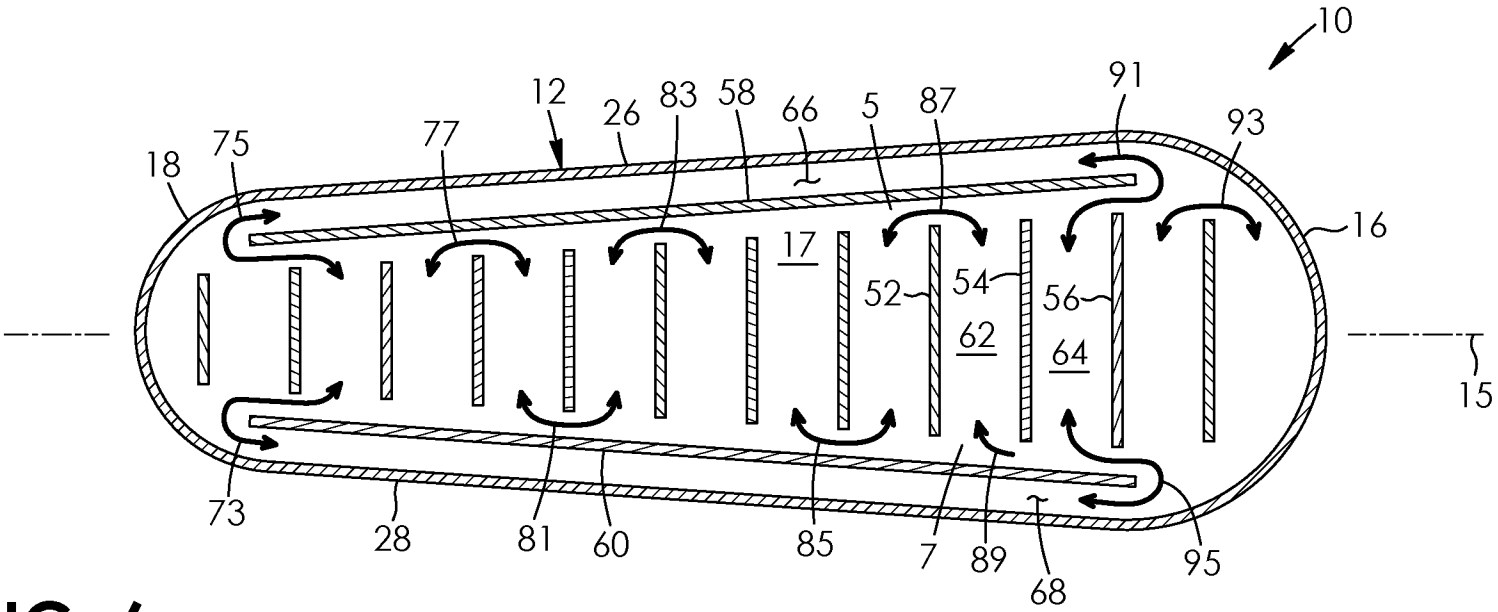
FIG. 6 is a sectional view taken along lines 6-6 of the portable ledge apparatus of FIG. 5.

There are corresponding suspension webs 20*a* and 20*b* disposed near the first end 16 of the inflatable platform 12, and there are corresponding suspension webs 22*a* and 22*b* disposed near the second end 18 of the inflatable platform 12. There are also corresponding suspension webs 24*a* and 24*b* disposed respectively between the suspension webs 20*a* and 20*b* and the suspension webs 22*a* and 22*b*. Respective ones of the corresponding suspension webs are disposed along opposite longitudinal sides 26 and 28 of the inflatable platform 12 and, in this example, the suspension webs 20*a*, 20*b*, 22*a*, 22*b*, 24*a*, and 24*b* are connect to or formed from the seam allowance the inflatable platform 12 and reinforced by the multiple layers of thermoplastic polyurethane and fibres. As seen in FIG. 6, the longitudinal axis 15 of the inflatable platform is positioned between the sides 26 and 28 of the inflatable platform.

Referring to FIG. 1, each of the suspension webs 20*a*, 20*b*, 22*a*, 22*b*, 24*a*, and 24*b* is connected to a respective one of suspension members, in this example suspension straps 30*a*, 30*b*, 32*a*, 32*b*, 34*a*, and 34*b*. The suspension straps 30*a*, 30*b*, 32*a*, 32*b*, 34*a*, and 34*b* are each coupled at a single point to a carabiner 36 to allow the portable ledge apparatus 10 to be anchored from a single point. The suspension webs 20*a*, 20*b*, 22*a*, 22*b*, 24*a*, and 24*b* are disposed along the longitudinal sides 26 and 28 of the inflatable platform 12 so that a load on the inflatable platform 12 is distributed equally across all the suspension straps 30*a*, 30*b*, 32*a*, 32*b*, 34*a*, and 34*b*. In this example, a rainfly 38 is also coupled to the carabiner 36, but this is not required. A further carabiner 40 is generally employed in examples where the rainfly 38 is also coupled to the carabiner 36.

In this example, there is also a height-adjustment assembly in this example an adjustable strap 41 which is best shown in FIG. 1A. The adjustable strap 41 is formed from a braided cord and has a first end portion 51 of rope. The first end portion of rope terminates in an end-splice 53 which inhibits unraveling thereof. The first end portion 51 of rope also includes a knot 55 adjacent to the end-splice in this example.

The adjustable strap 41 has a second end portion 57 of rope which is loop-shaped in part and which comprises a first loop 59 of the adjustable strap in this example. The second end portion of rope terminates in an eye-splice 61 in this example. Loop 59 formed by the eye-splice of the second end portion 57 is an anchor point that may be used to couple the adjustable strap 41 to a coupling member, in this example a carabiner 43 that is coupled to the rainfly 38 seen in FIG. 1.

Referring back to FIG. 1A, the second end portion 57 includes a hollow sub-portion 63. The first end portion 51 is positioned so as to extend through the hollow sub-portion. Friction inside the hollow sub-portion 63 prevents the inside from pulling out.

Threading the braided cord into itself in this manner also forms a second loop 65. The second loop may be used to couple the adjustable strap 41 to the carabiner 36 of a suspended load, in this example the portable ledge apparatus 10. The second loop 65 comprises a first vertically-extending piece of cord 67 comprising the hollow sub-portion 63 of the second end portion. The second loop further comprises a second vertically-extending piece of cord 69 coupled to first vertically-extending piece of cord.

The portable ledge apparatus 10 seen in FIG. 1 due to gravity causes a downward force, as shown by arrow of numeral 71, being applied to both pieces of cord 67 and 69 of the second loop 65 of the adjustable strap 41 seen in FIG. 1A simultaneously. This causes hollow sub-portion 63 to extend in length and constrict in cross-section, and frictionally engage or pinch the first end portion 51. Pulling downwards on cord 67 also causes the hollow sub-portion to constrict and frictionally engage the first end portion.

Pulling on the first end portion 51 via knot 55, for example, causes the second loop 65 to reduce in size and causes the inflatable platform 12 seen in FIG. 1 to selectively rise upwards relative to the FIGS. 1 and 1A.

Selectively pulling downwards on cord 69 causes the hollow sub-portion 63 to shorten in length and expand in cross-section and enable the first end portion 51 to selectively extend therethrough up to the point where knot 55 abuts adjacent to the hollow sub-portion 63. The second loop 65 thus expands in size and the inflatable platform 12 seen in FIG. 1 is selectively lowered relative to FIGS. 1 and 1A thereby.

Positioning a threaded portion of the adjustable strap 41 within the eye of the eye-splice thus forms a closed loop with an adjustable function. The adjustable function is achieved by having the second end portion 57 pinching the braided cord that is fed back through the hollow sub-portion 63 when a load is applied.

Referring back to FIGS. 1 and 2, the suspension straps 30*a*, 30*b*, 32*a*, 32*b*, 34*a*, and 34*b* may each be provided with a respective loop, for example, loops 42 and 44 shown for one of the straps 30*a*. There may also be bottom strap 46 which, in this example, extends transversely between the opposite longitudinal sides 26 and 28 of the inflatable platform 12, but a bottom strap is not required. The position of the loops 42 and 44 on the suspension straps provide the option to suspend the portable ledge apparatus 10 by a carabiner. This results in the portable ledge apparatus being suspended at a substantial distance to the anchor point. The purposes of this is to allow anchoring the portable ledge apparatus 10 in less than optimal terrain such as caves with tight spaces and obstructions, and for suspending the portable ledge apparatus 10 from a lowering or repelling system when the portable ledge apparatus is employed as a rescue stretcher with a rescuer attending to a rescue who is in a prone position on the portable ledge.

The inflatable platform 12 is provided with a valve 48 which is employed to inflate the inflatable platform 12. The valve 48 is disposed near the first end 16 of the inflatable platform 12. The valve 48 is provided with a cord 50 which may be secured to a designated location to prevent the valve 48 from being accidentally opened.

As seen in FIGS. 3 and 6, the inflatable platform 12 is also provided with a plurality of spaced-apart transverse baffles, for example, transverse baffles 52, 54 and 56 disposed within the interior 17 thereof. Referring to FIG. 6, the transverse baffles extend between the longitudinal sides 26 and 28 of the inflatable platform and extend perpendicular to longitudinal axis 15 of the inflatable platform. The transverse baffles are spaced-apart at intervals from adjacent first end 16 to adjacent second end 18 of the inflatable platform 12. As seen in FIG. 3, the baffles 52, 54 and 56 couple to and extend between the top 9 and bottom 11 of the inflatable platform 12.

As seen in FIG. 6, the inflatable platform 12 is provided with a pair of spaced-apart longitudinal baffles 58 and 60. Baffle 58 is positioned adjacent to side 26 of the inflatable platform and baffle 60 is positioned adjacent to side 28 of the inflatable platform in this example. The transverse baffles 52, 54 and 56 are disposed between and are enclosed by the longitudinal baffles 58 and 60. However, the transverse baffles 52, 54 and 56 do not contact the longitudinal baffles 58 and 60, with gaps being provided between adjacent baffles, as shown in FIG. 6 by gap 5 between baffles 52 and 58, and gap 7 between baffles 52 and 60. This allows air to flow around the baffles when the inflatable platform 12 is being inflated, as shown by arrows 73, 75, 77, 79, 81, 83, 85, 87, 89, 91, 93 and 95. As seen in FIG. 4, the baffles 58 and 60 couple to and extend between the top 9 and bottom 11 of the inflatable platform 12.

Still referring to FIG. 6, the inflatable platform 12 is made out of one air chamber that is sub-divided by transversal and longitudinal sub-chambers in this example. Referring to FIG. 3, the transverse baffles 52, 54 and 56 thus define a plurality of transverse sub-chambers in the inflatable platform 12 each being formed by adjacent transverse baffles and the top 9 and bottom 11 of the inflatable platform. This is shown by transverse or transversely-extending sub-chamber 62 defined by transverse baffles 52 and 54 and top 9 and bottom 11 of the inflatable platform 12, and transverse or transversely-extending sub-chamber 64 defined by transverse baffles 54 and 56 and the top and bottom of the inflatable platform. Each transversely-extending sub-chamber is a rectangular in shape in top and side profile in this example.

As seen in FIG. 4, the inflatable platform 12 has a first longitudinally-extending sub-chamber 66 formed by longitudinal baffle 58 and the top 9, bottom 11 and longitudinal side 26 of the inflatable platform. The inflatable platform has a second longitudinally-extending sub-chamber 68 formed by longitudinal baffle 60 and the top, the bottom and longitudinal side 28 of the inflatable platform. Each longitudinally-extending sub-chamber is elongate and has an outer portion that is curved and circular in cross-section in this example.

The transversely-extending sub-chambers 62 and 64 and longitudinally-extending sub-chambers 66 and 68 form an air space that insulates against conductive heat loss. The sub-chambers as herein described may be referred to as air passageways.

Figure 4A:
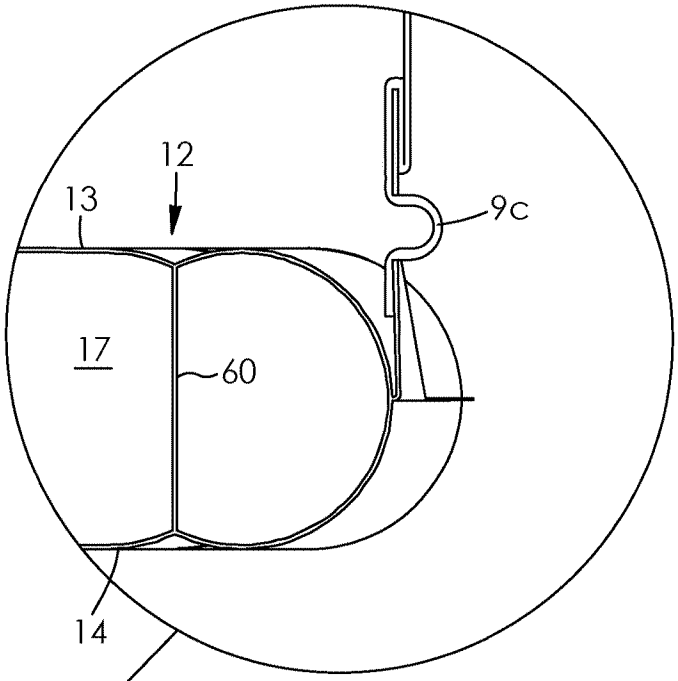
FIG. 4A is an enlarged view of a connection webbing loop of the portable ledge apparatus of FIG. 1.
Figure 4:
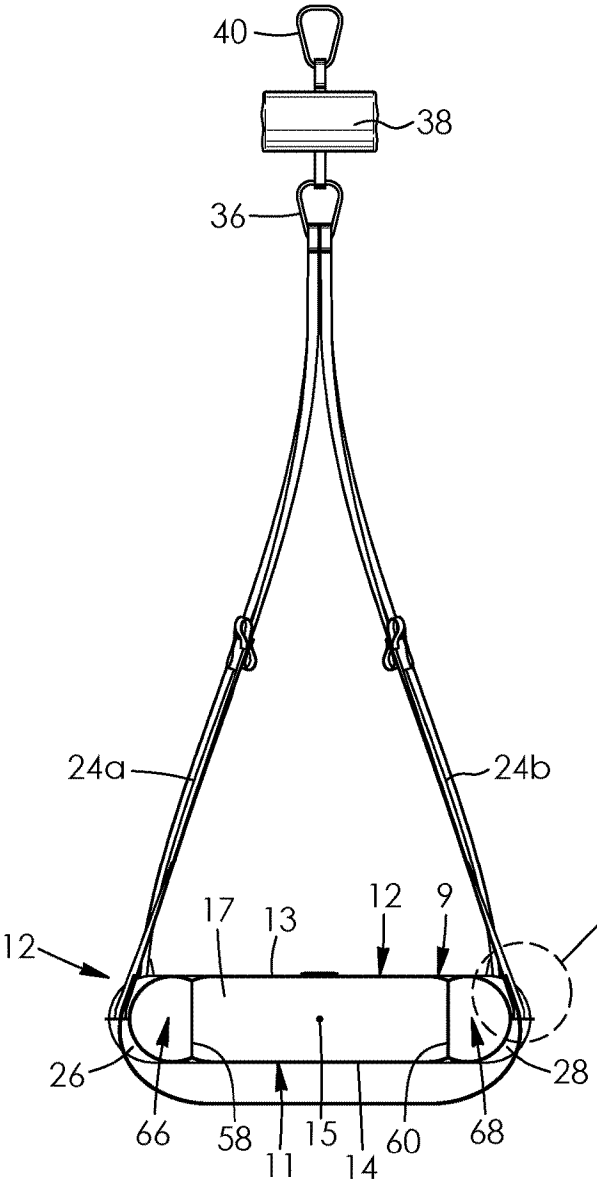
FIG. 4 is a transverse cross-sectional view of the portable ledge apparatus of FIG. 1 taken along lines 4-4 of FIG. 2.
Figure 5:
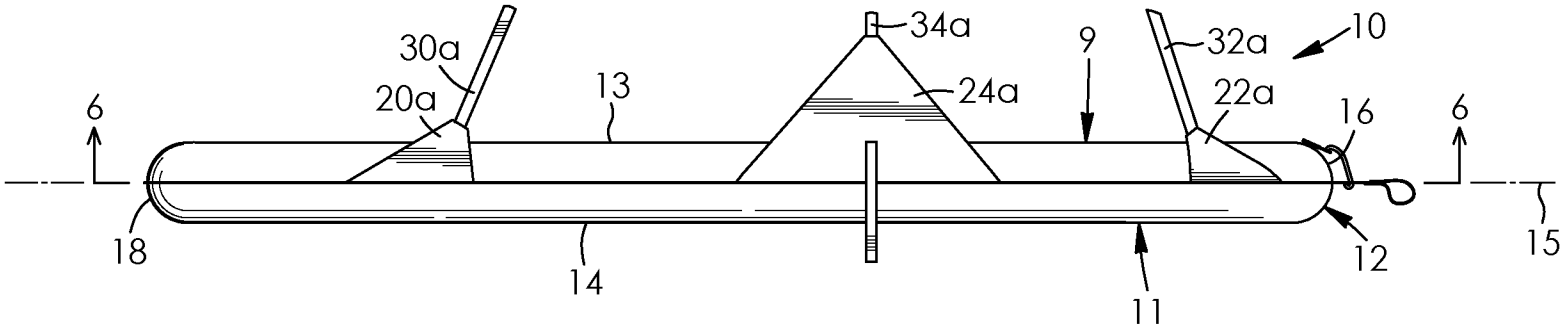
FIG. 5 is a side elevation, fragmented view of the portable ledge apparatus of FIG. 1.

FIG. 4A shows a connection webbing loop 9*c* of a suspension web of the portable ledge apparatus 10. The connection webbing loop allows adjacent portable ledge apparatuses to be coupled.

Figure 7:
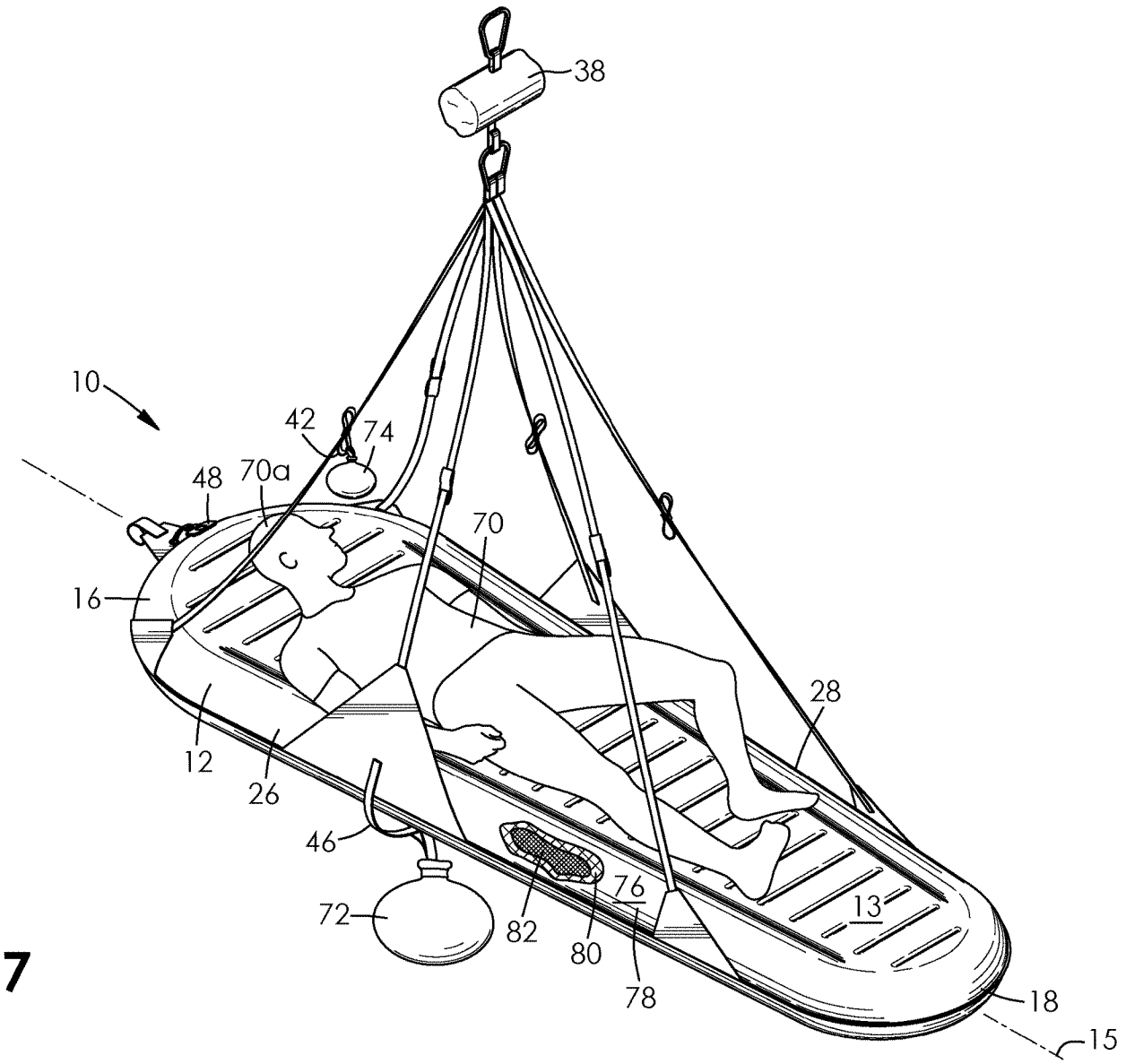
FIG. 7 is a perspective view showing use of the portable ledge apparatus of FIG. 1.

FIG. 7 shows the inflatable portable ledge apparatus 10 is use. A user 70 will generally lie with their head 70*a* near the first end 16 of the inflatable platform 12. The valve 48 is also disposed near the first end 16 of the inflatable platform 12. This allows the user 70 to add air to the inflatable platform 12 at night, if there is a slow leak, without having to move from a sleeping position. The user 70 may also stand on the inflatable platform 12 without causing the inflatable platform 12 to collapse inwardly and/or bow longitudinally. The transverse baffles 52, 54 and 56 prevent the inflatable platform 12 from collapsing inwardly. The longitudinal baffles 58 and 60 prevent the transverse baffles from bowing longitudinally. The user may also hang a bag 72 from the bottom strap 46 and/or a bag 74 from the loops, for example, loop 42 on the suspension straps. The inflatable platform 12 is also provided with wear patch 76 bonded to the longitudinal sides 26 and 28 thereof. The wear patch comprises a plurality of layers, namely, a first layer 78 having a first color, a second layer 80 having a second color, and third layer 82 having a third color. When the first layer 78 wears away, the second layer 80 will become visible and provide a visual warning to the user that the caution should be taken. When the second layer 80 wears away, the third layer 82 will become visible and provide a visual warning to the user that repairs are required.

Figure 8:
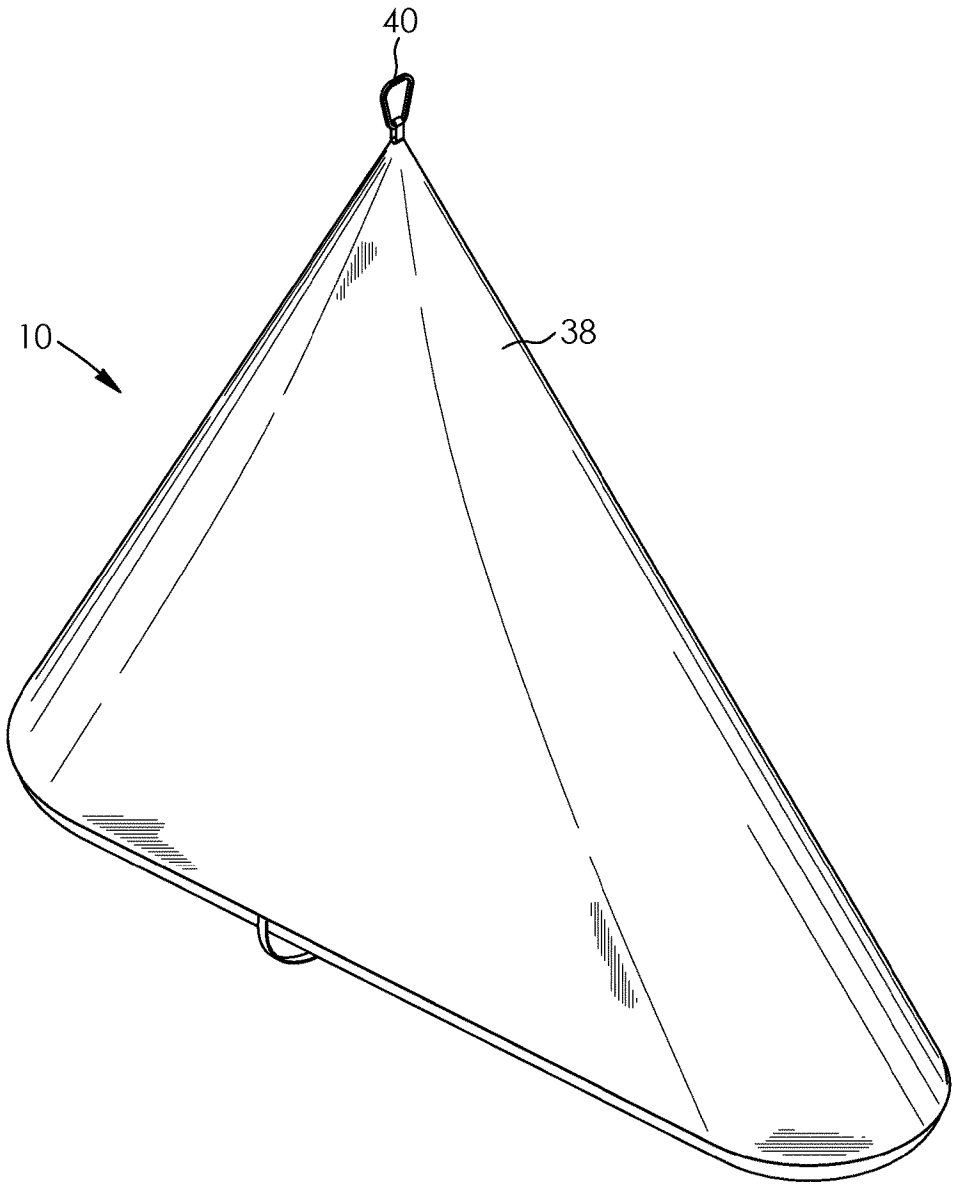
FIG. 8 is a perspective view showing a rainfly deployed to cover the portable ledge apparatus of FIG. 1.
Figure 9:
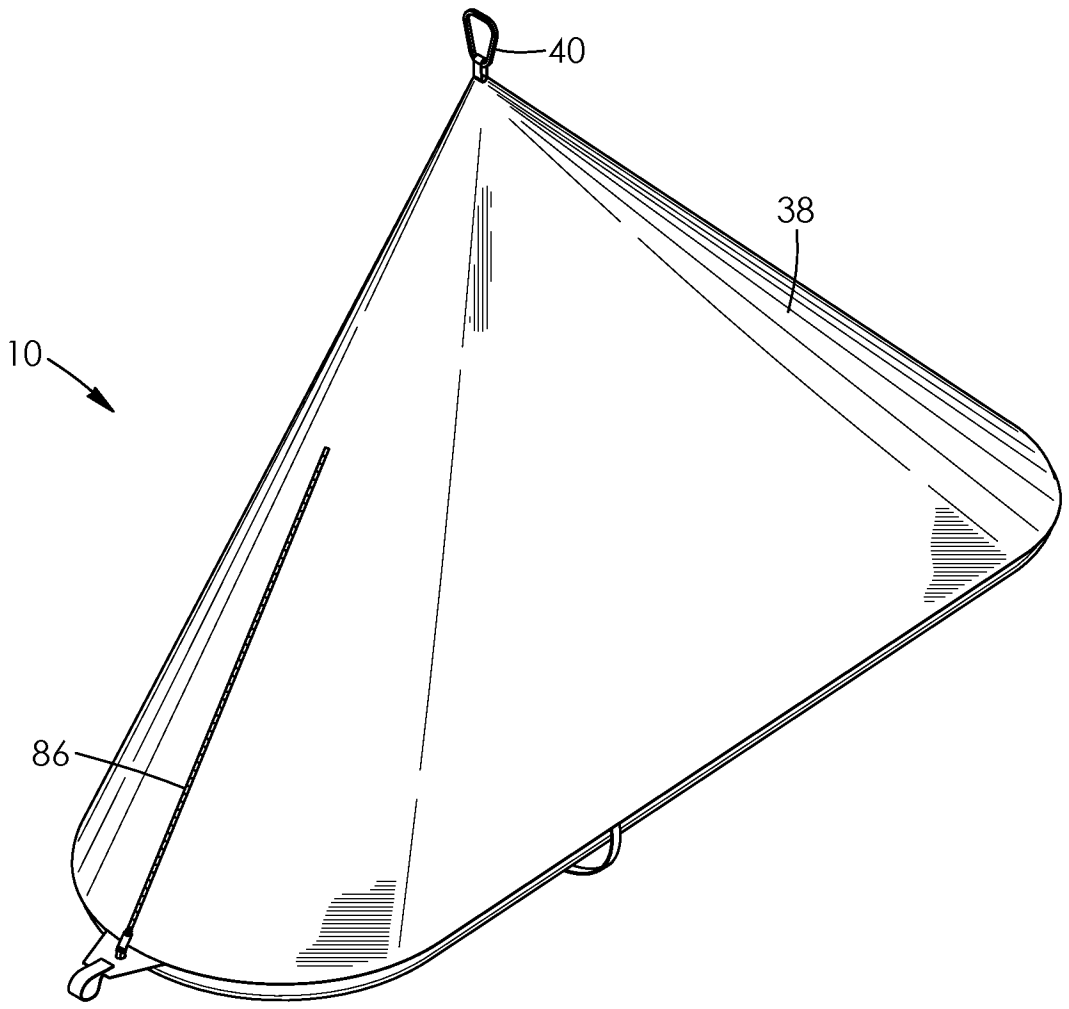
FIG. 9 is another perspective view showing the rainfly deployed to cover the portable ledge apparatus of FIG. 1.

The rainfly 38 may be deployed to cover the portable ledge apparatus as shown in FIGS. 8 and 9. The rainfly is closed by a single zipper 86 which is best shown in FIG. 9.

Figure 10:
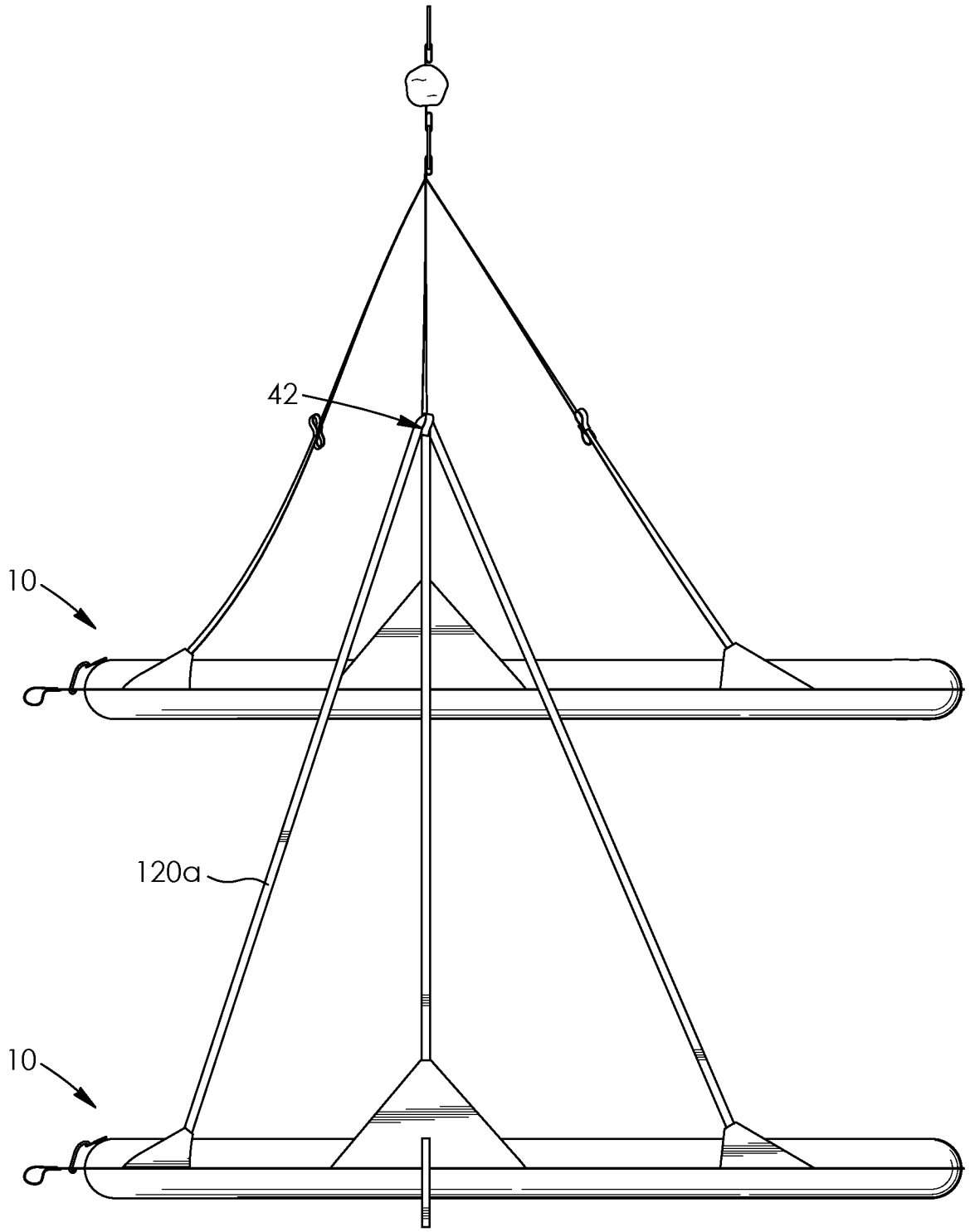
FIG. 10 is a perspective view showing the portable ledge apparatus of FIG. 1 coupled to another substantially identical portable ledge apparatus in a vertical configuration.
Figure 11:
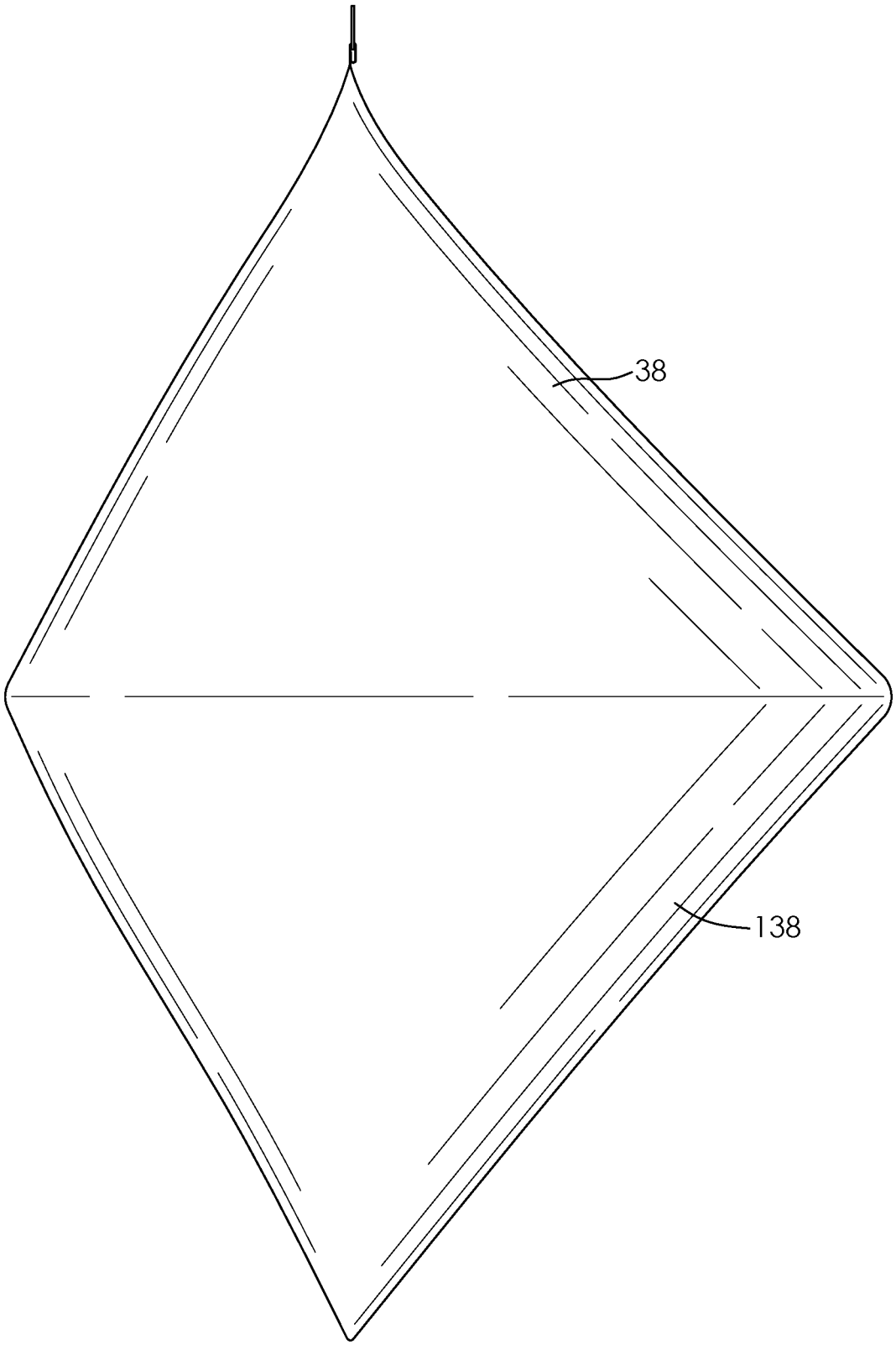
FIG. 11 is a perspective view showing rainflies deployed cover the portable ledge apparatuses of FIG. 10.
Figures 12, 13:
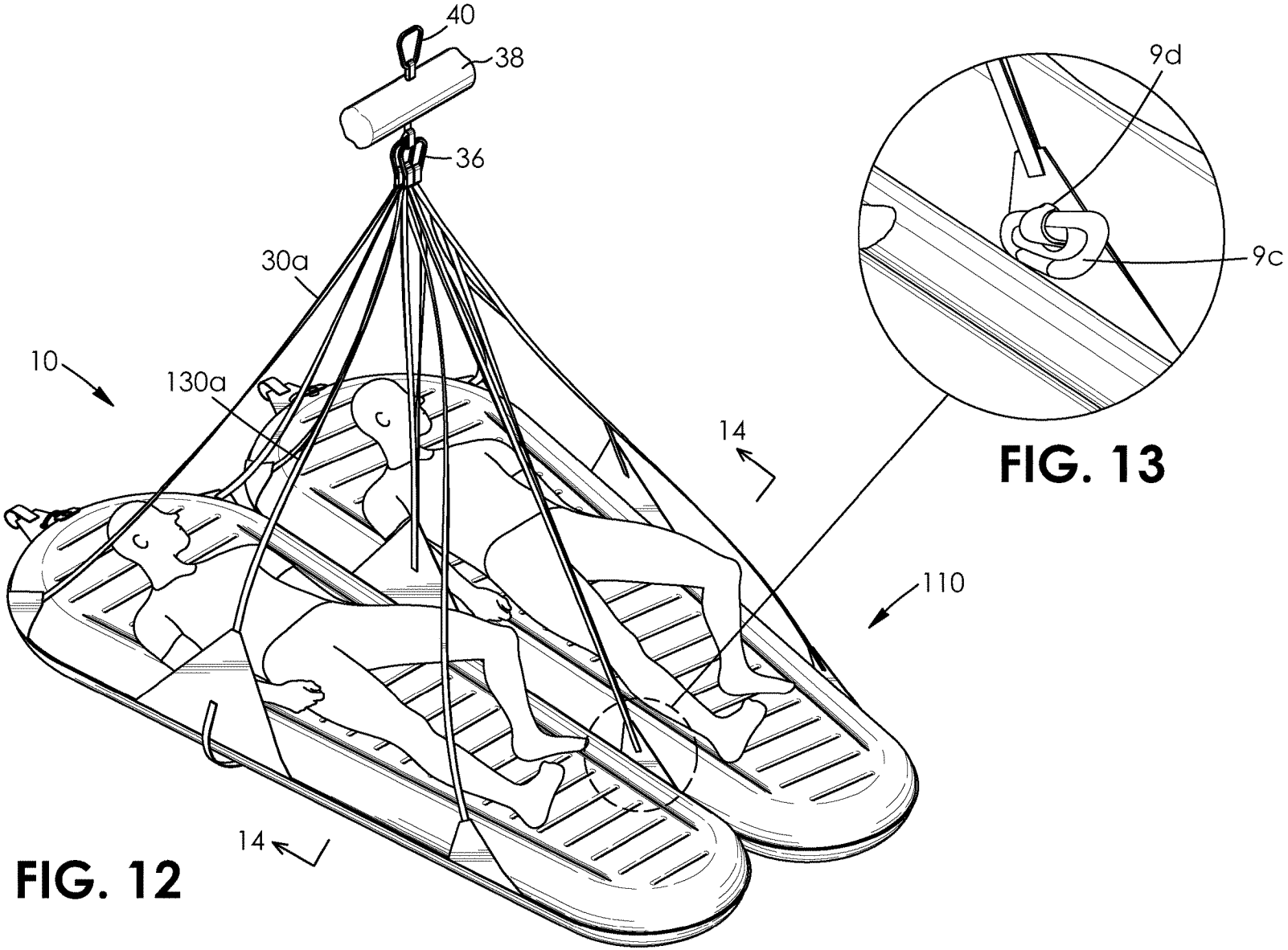
FIG. 12 is a perspective view showing the portable ledge apparatus of FIG. 1 coupled to another substantially identical portable ledge apparatus in a horizontal configuration.
FIG. 13 is an enlarged view of connection webbing loops of the portable ledge apparatuses of FIG. 12.
Figures 14, 15:
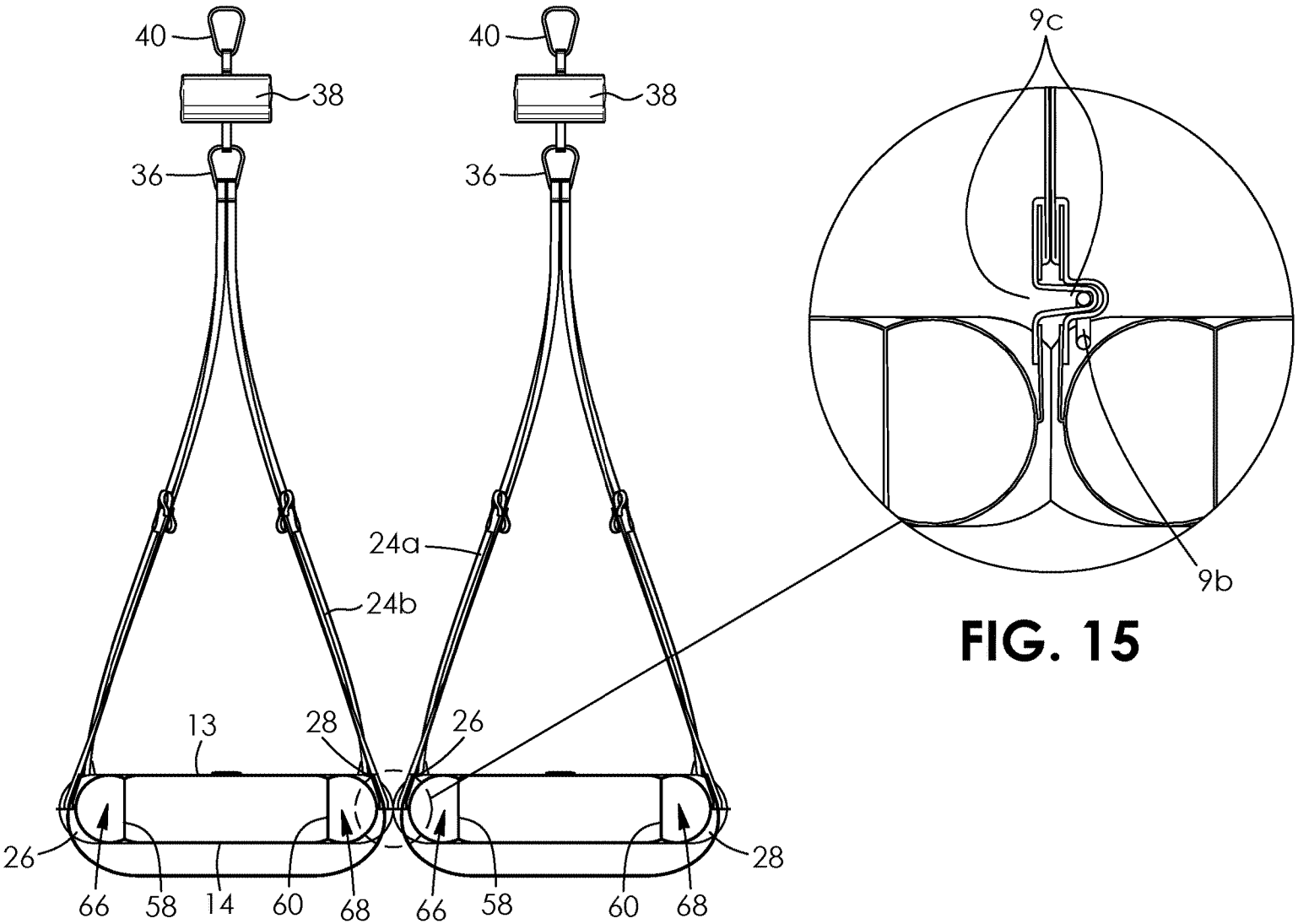
FIG. 14 is a transverse cross-sectional view of the portable ledge apparatuses of FIG. 1 taken along lines 14-14 of FIG. 12.
FIG. 15 is an enlarged view of connection webbing loops of the portable ledge apparatuses of FIG. 14.

It is possible to couple to the portable ledge apparatus 10 to a substantially identical portable ledge apparatus 110 in a vertical configuration, as shown in FIG. 10. The suspension straps, for example, suspension strap 120*a* of the portable ledge apparatus 110 are coupled to respective loops, for example, loop 42 of the portable ledge apparatus 10. Rainflies 38 and 138 may be deployed in a diamond configuration to cover the coupled portable ledge apparatuses 10 and 110 as shown in FIG. 11. It is also possible to couple the portable ledge apparatus 10 to the portable ledge apparatus 110 in a horizontal configuration, as shown in FIG. 11. As seen in FIG. 12, the respective suspension straps of each of the portable ledge apparatuses 10 and 110, for example, respective suspension straps 30*a* and 130*a* are coupled to the carabiner 36. FIGS. 13 and 13A show connection webbing loops 9*c* coupled together by a carabiner 9*d*. This allows for a stable connection.

Figure 16:
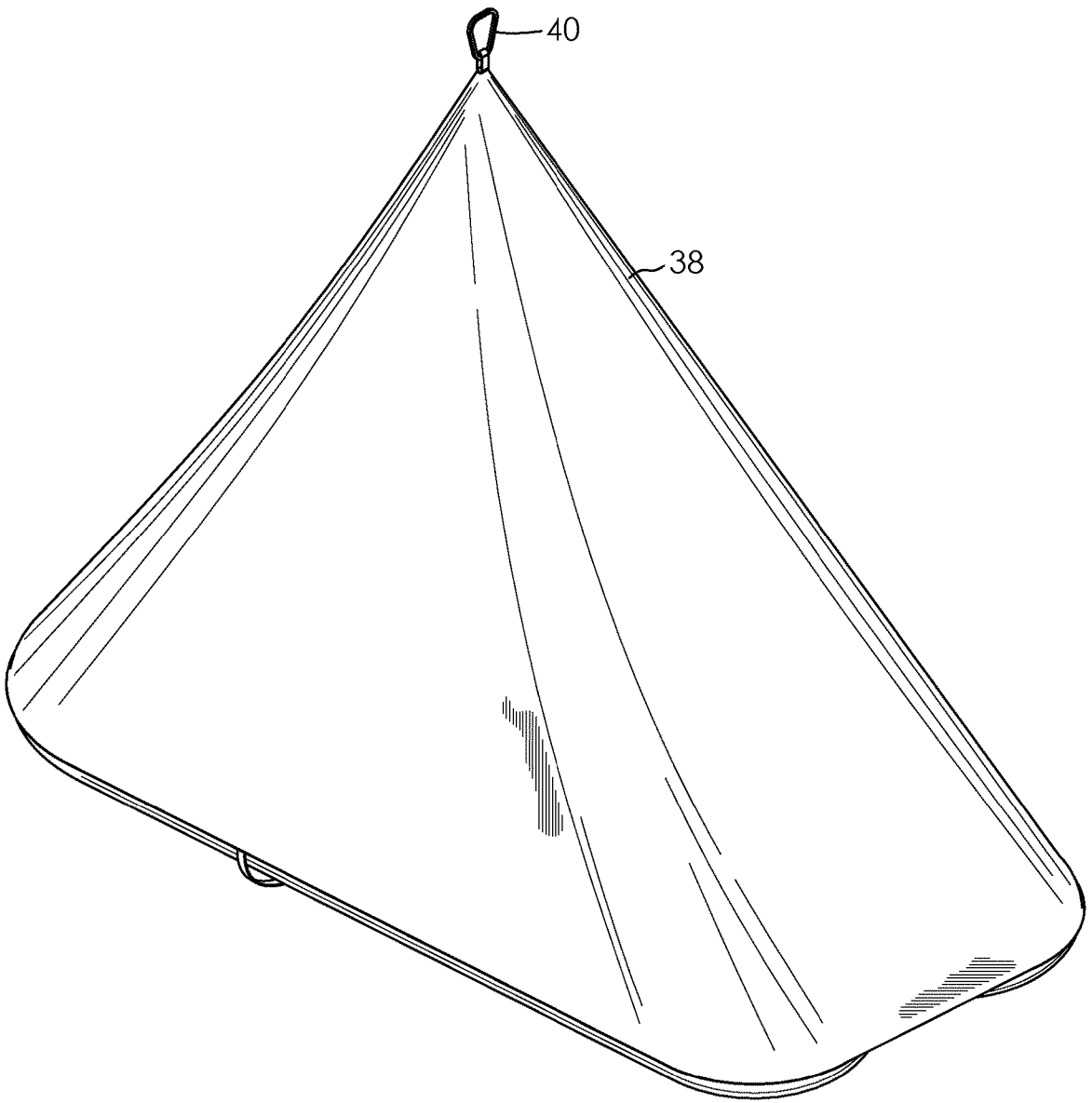
FIG. 16 is a perspective view showing a rainfly deployed to cover the portable ledge apparatuses of FIG. 14
Figure 17:
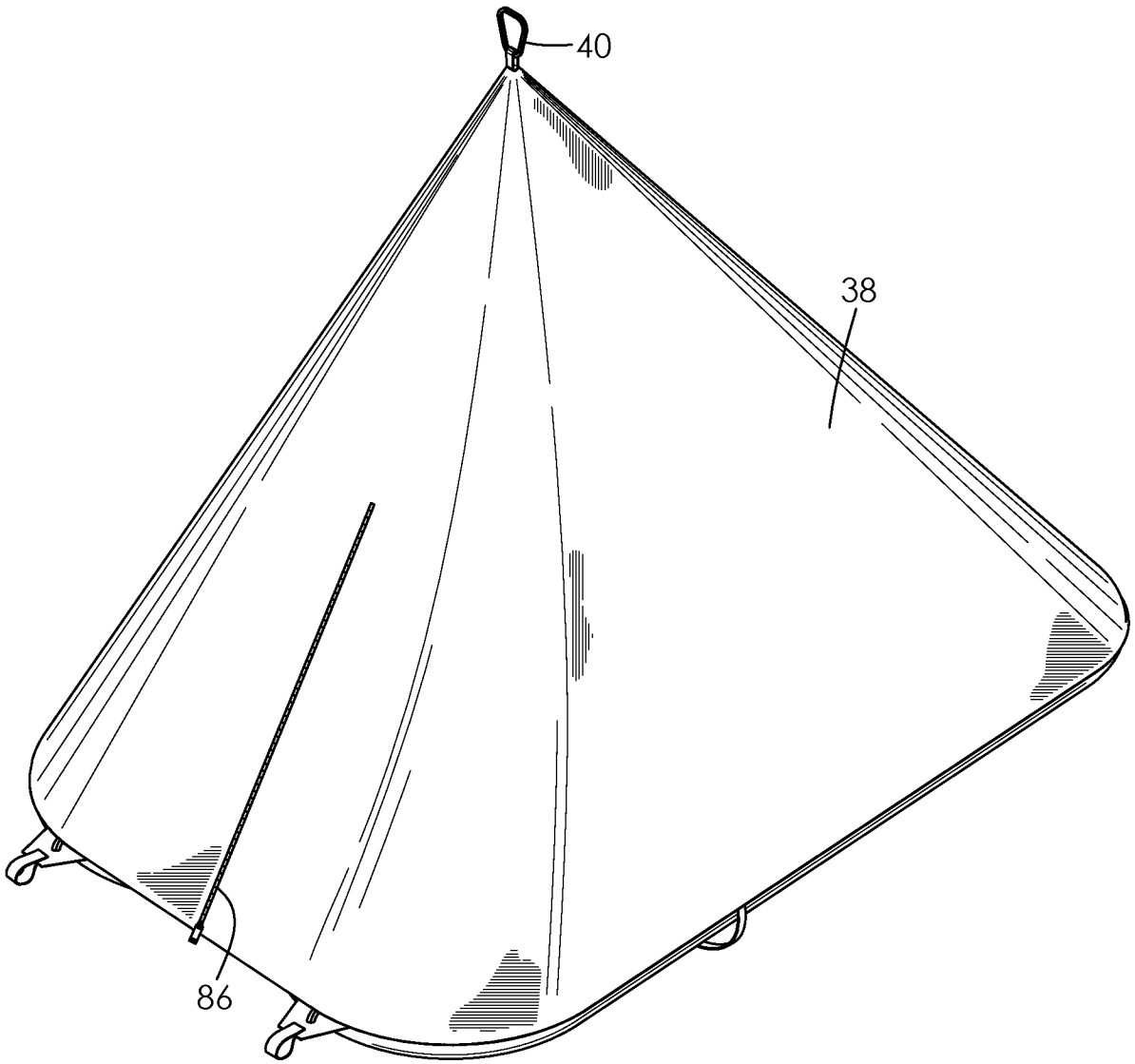
FIG. 17 is a perspective view showing a rainfly deployed to cover the portable ledge apparatuses of FIG. 14.

The rainfly 38 may be deployed to cover the portable ledge apparatuses 10 and 110 as shown in FIGS. 12 and 16. The rainfly 38 can cover both the portable ledge apparatuses 10 and 110 because of an addition of material, for example fabric, to a circumference of the rainfly 38 to cover portable ledge apparatuses 10 and 110 as shown in FIG. 17.

Figure 18:
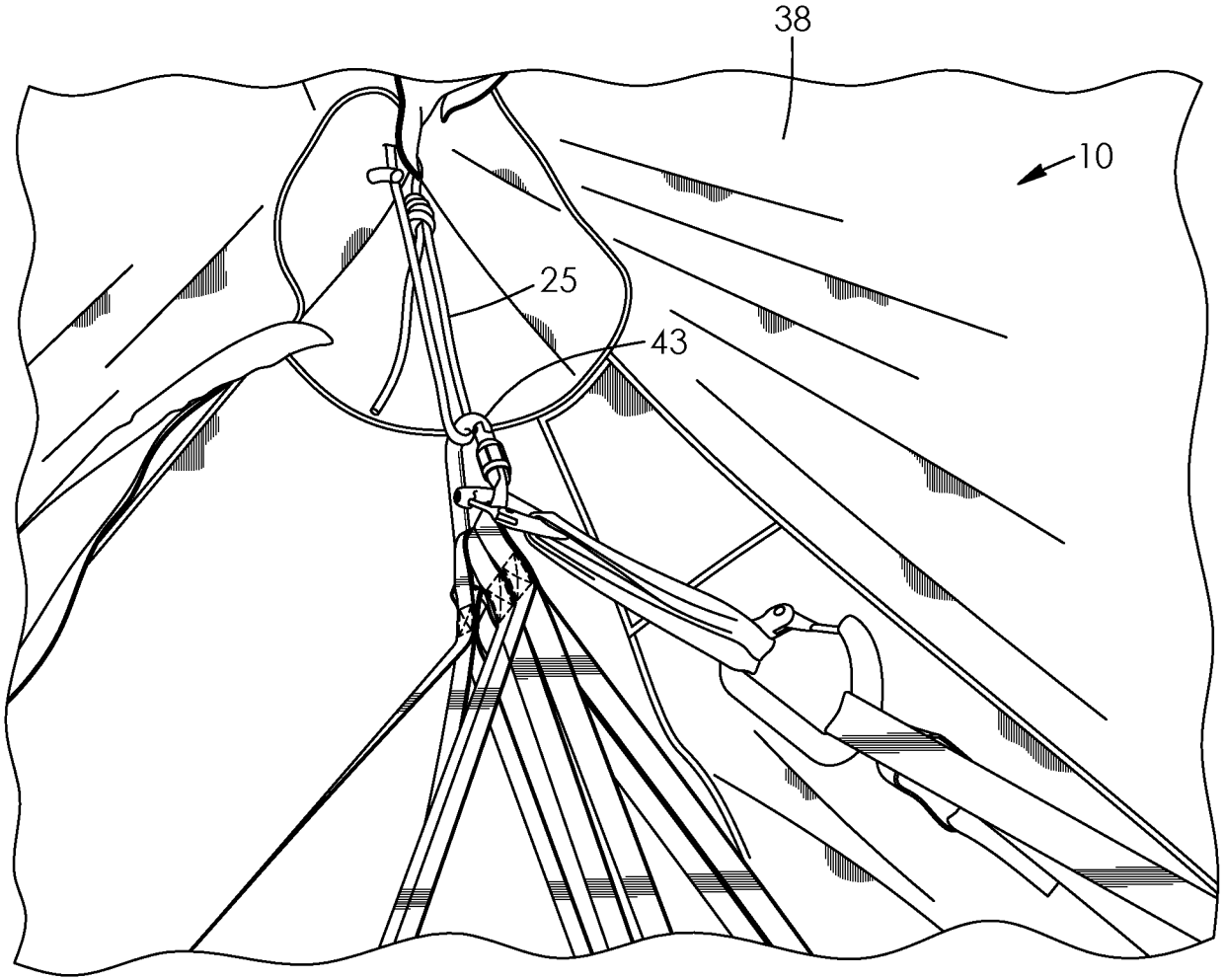
FIG. 18 is a perspective, fragmentary view within the rainfly of the portable ledge apparatuses of FIG. 17.
Figure 19:
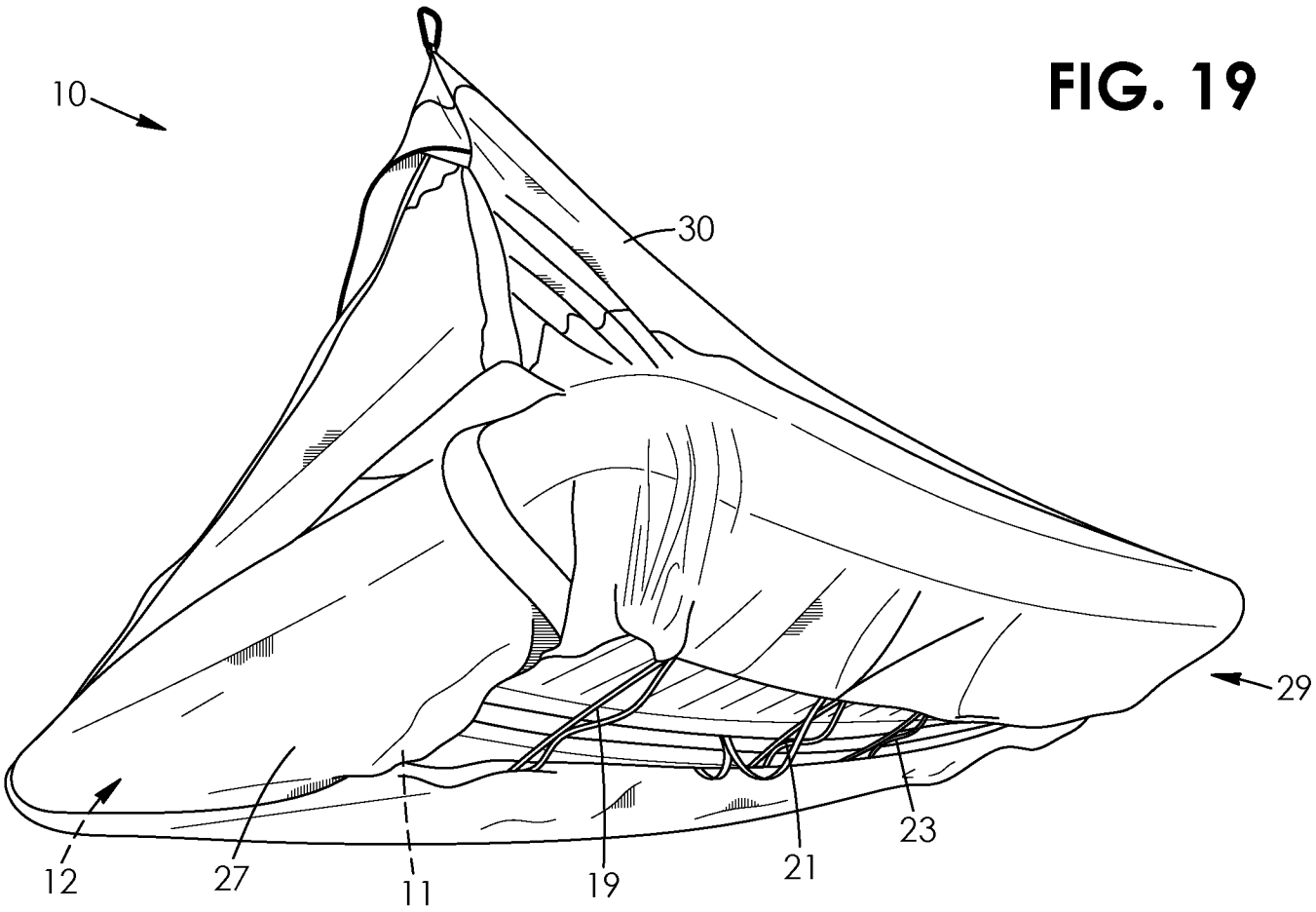
FIG. 19 is a bottom, side, front perspective view of the portable ledge apparatuses of FIG. 17.
Figure 20:
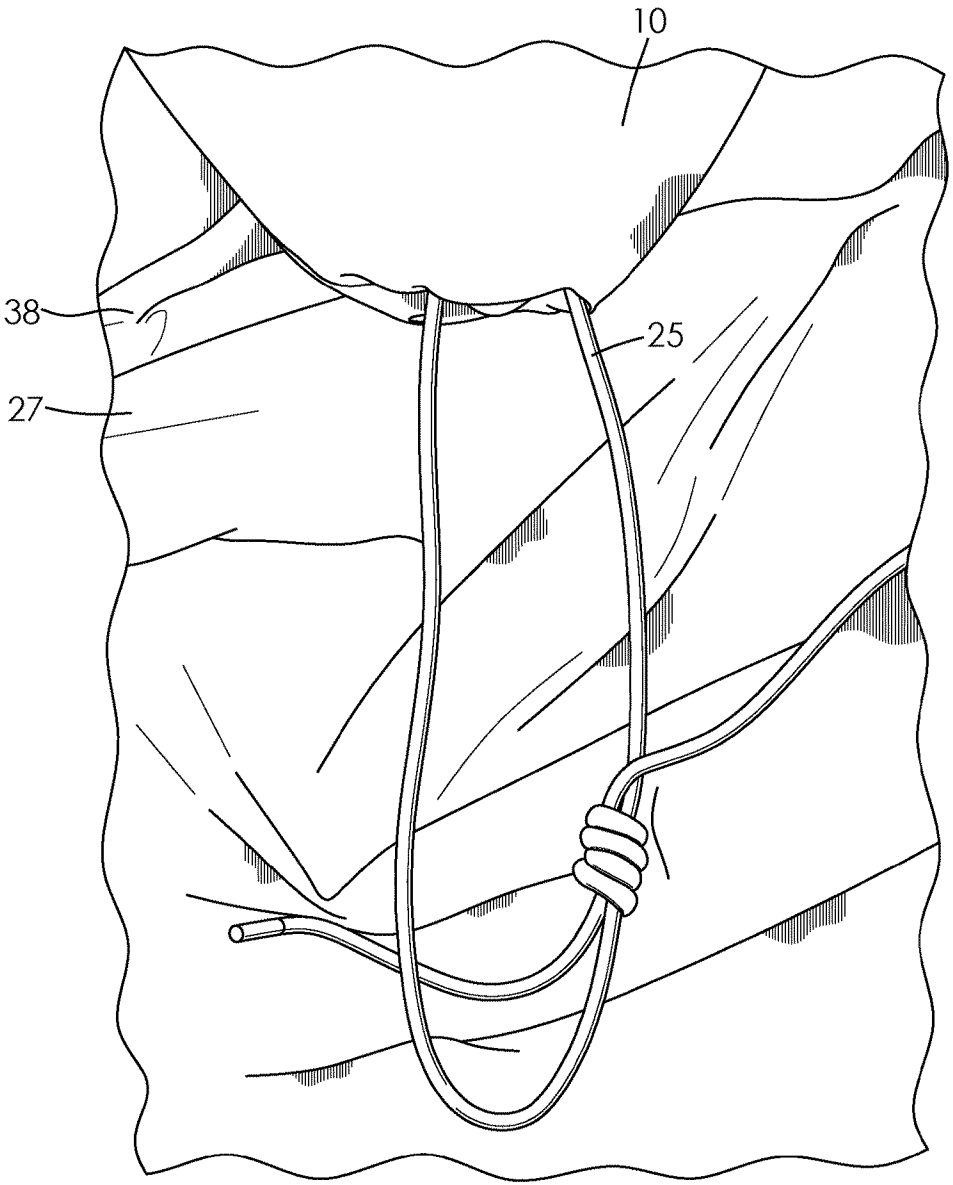
FIG. 20 is a bottom perspective, fragmentary view of the top of the rainfly of the portable ledge apparatuses of FIG. 17.

As seen in FIG. 18, the rainfly 38 is structurally connected to the apparatus 10 by a loop of cord 25 threaded inside the top loop of the rainfly to which the apparatus 10 is suspended. Referring to FIG. 19, the bottom 27 of the rainfly extends about the bottom 11 of the inflatable platform 12. As seen in FIG. 20, an elastic cord 29 in the bottom of the rainfly 38 constrains the fabric and allows the rainfly to stay under the inflatable platform. As seen in FIG. 19, there also three compressions straps 19, 21 and 23 that retain the rainfly under the inflatable platform 12.

Figure 21:
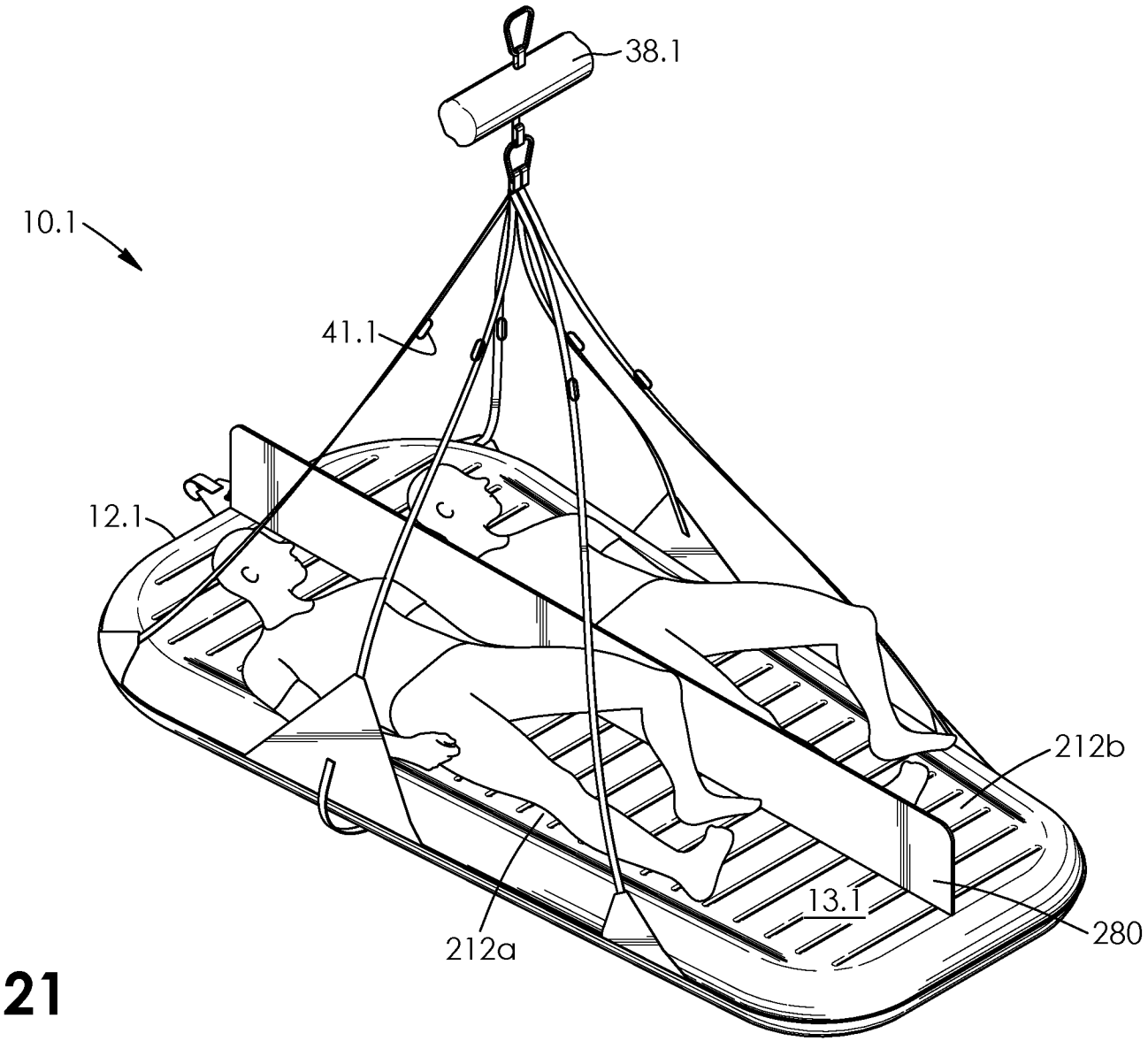
FIG. 21 is a perspective view of an inflatable, portable ledge apparatus according to a second aspect.
Figure 22:
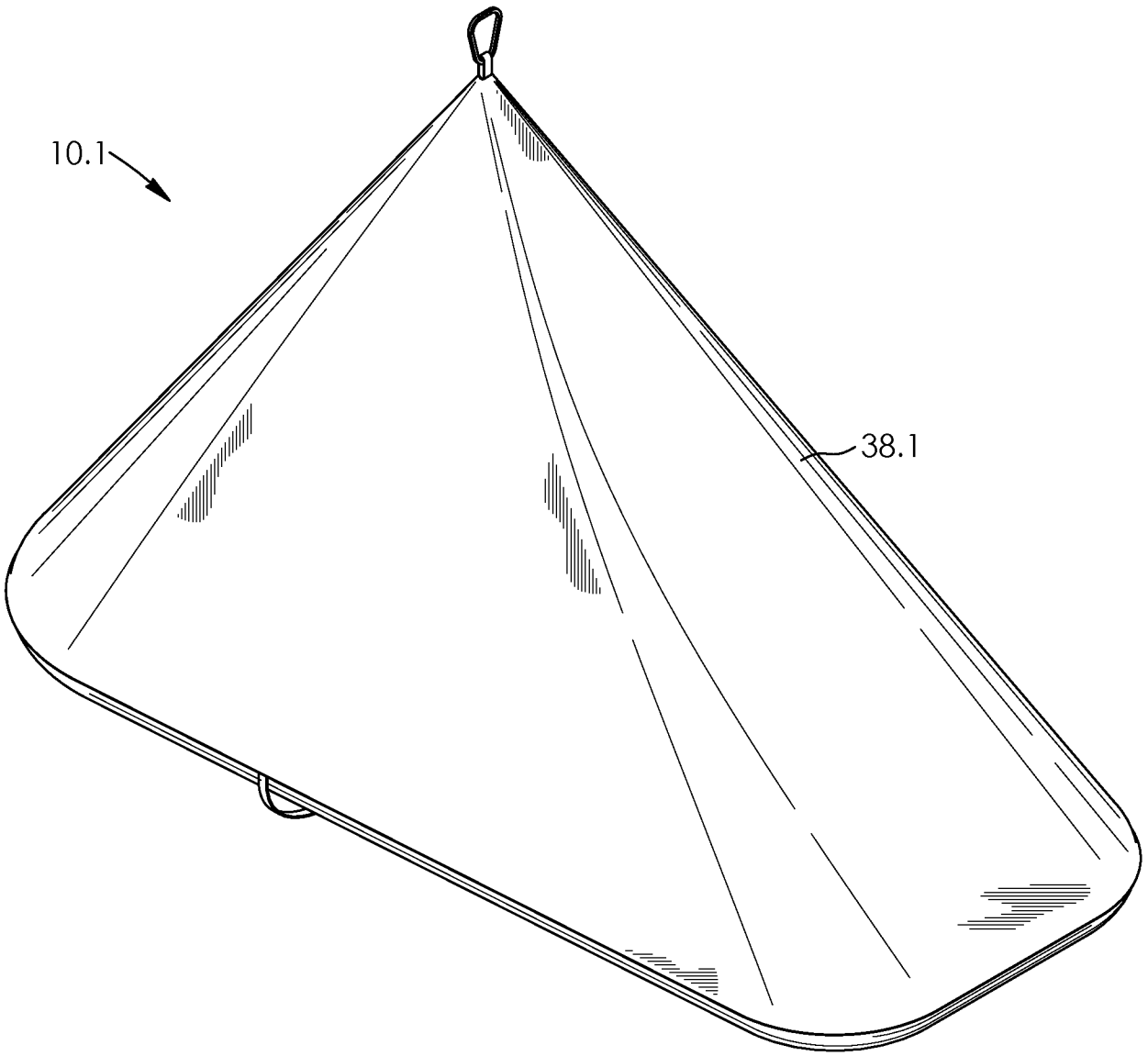
FIG. 22 is a perspective view showing a rainfly deployed to cover the portable ledge apparatus of FIG. 21.

FIGS. 21 to 22 show an inflatable portable ledge apparatus 10.1 according to a second embodiment. Like parts have like numbers and function as the embodiment shown in FIGS. 1 to 20 with the addition of "0.1". Inflatable portable ledge apparatus 10.1 is substantially the same as inflatable portable ledge apparatus 10 shown in FIGS. 1 to 20 with the following exceptions.

Another portable ledge apparatus 10.1 is shown in FIG. 21. The portable ledge apparatus 10.1 is substantially identical to the portable ledge apparatus shown in FIGS. 1 to 4 with the notable exception that the portable ledge apparatus 10.1 is a twin portable ledge apparatus which is about double in size relative to the portable ledge apparatus 10. The portable ledge apparatus 10.1 is also provided with a divider 280 which separates a first portion 212*a* of an inflatable platform 12.1 from a second portion 212*b* of the inflatable platform 12.1. The portable ledge apparatus 10.1 is a twin portable ledge apparatus but may be covered by the rainfly 38.1, as shown in FIG. 22, in a similar manner as described above when the portable ledge apparatuses 10 and 110 are coupled in a horizontal configuration. The portable ledge apparatus may also be provided with adjustable straps, for example adjustable strap 41.1, disposed along respective suspension straps thereof. The adjustable strap 41.1 is substantially similar in function to adjustable strap 41 shown in FIG. 1A.

Figure 23:
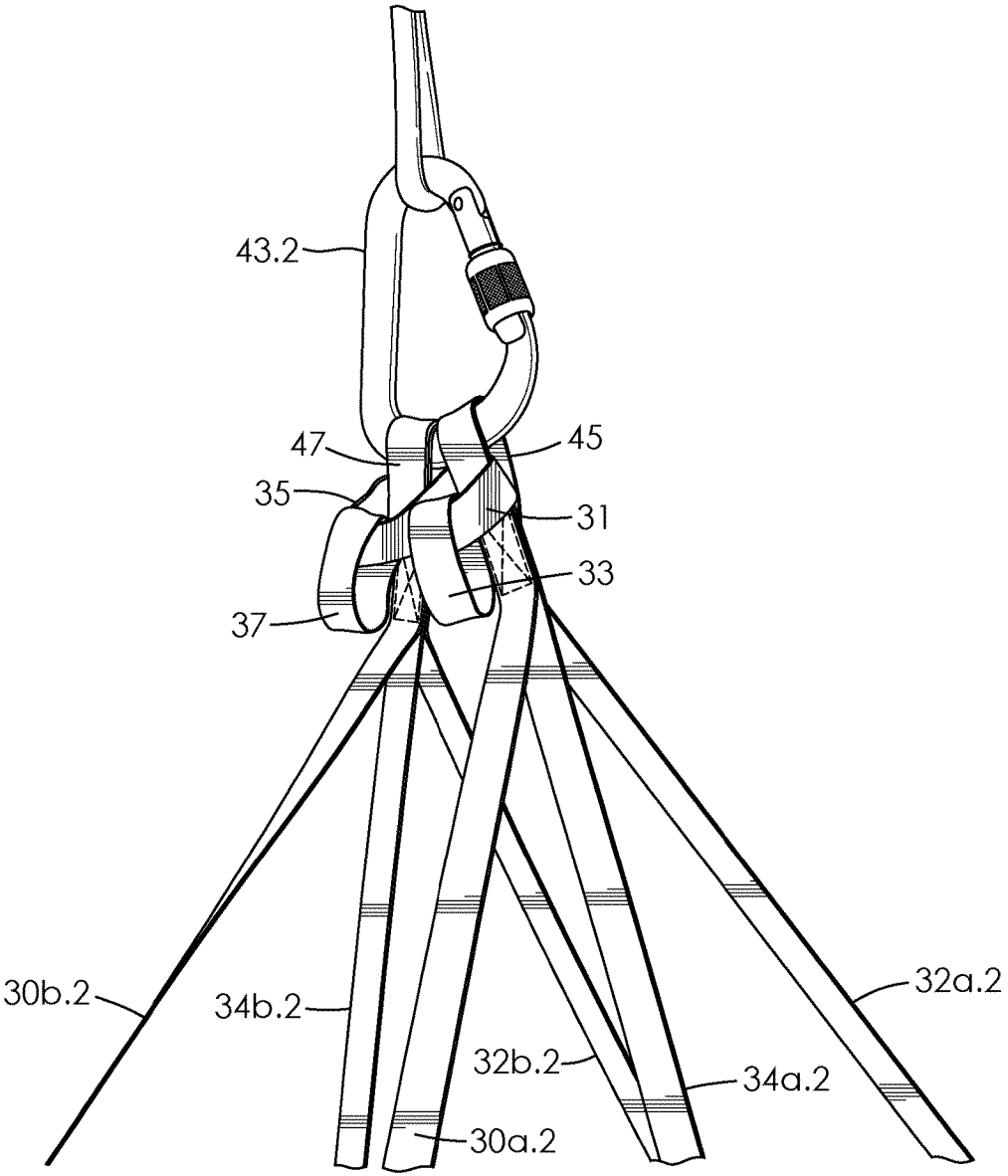
FIG. 23 is a perspective view of a plurality of straps and links of an inflatable, portable ledge apparatus according to a third aspect.
Figure 24:
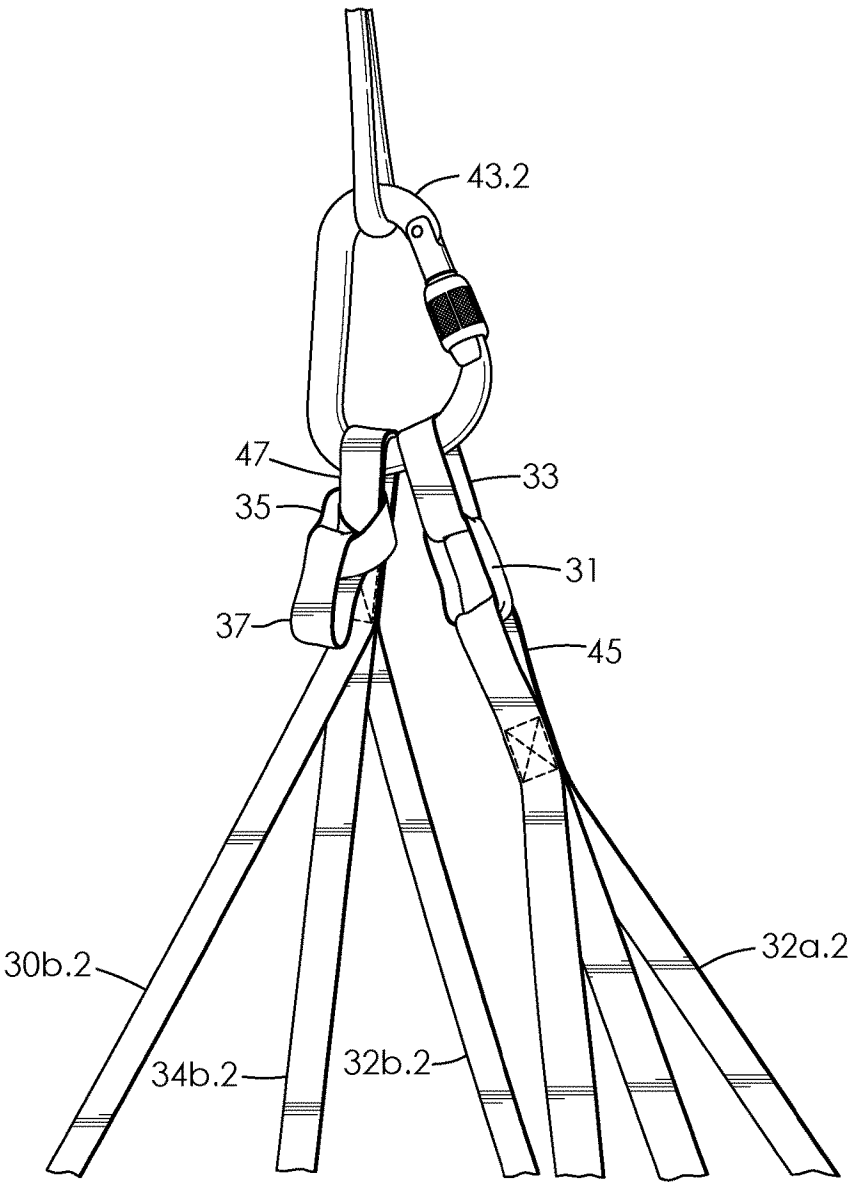
FIG. 24 is a perspective view of the portable ledge apparatus of FIG. 23, with the link configuration thereof enabling asymmetric suspension of the portable ledge apparatus in a first mode.
Figure 25:
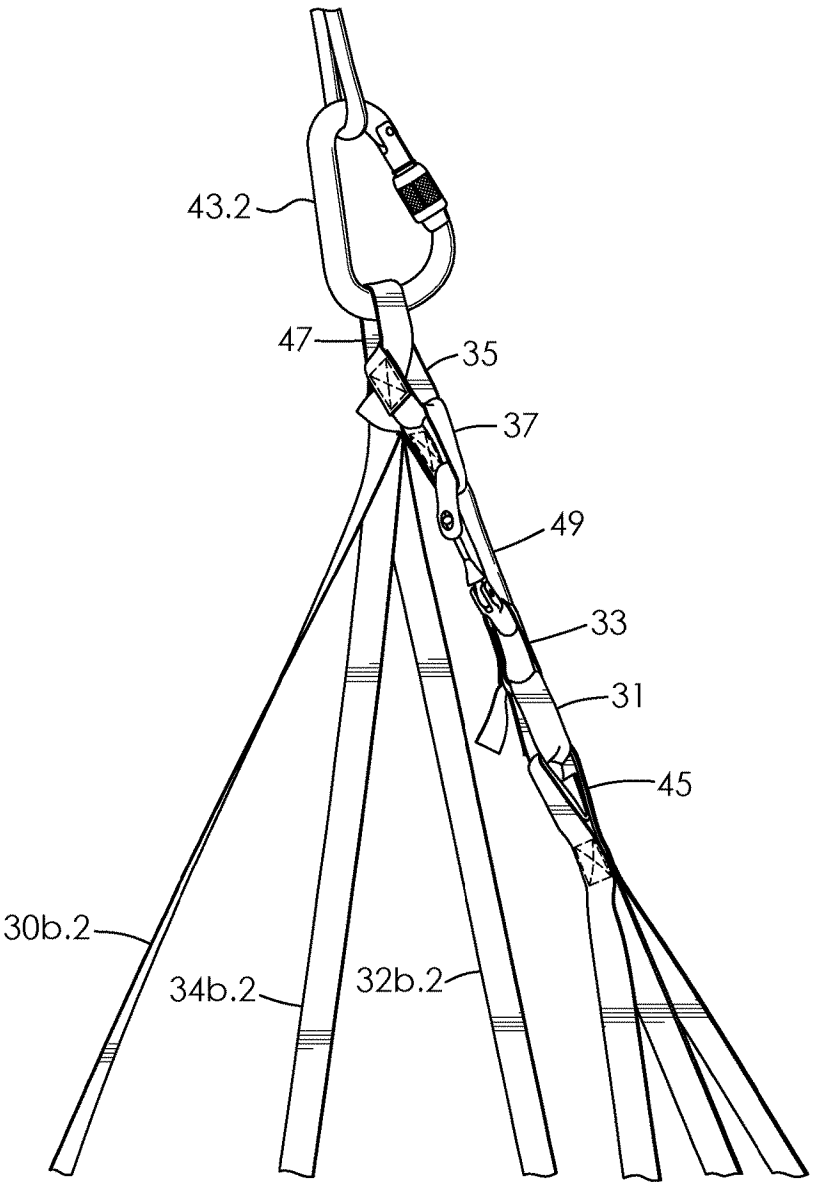
FIG. 25 is a perspective view of the portable ledge apparatus of FIG. 23, with the link configuration thereof enabling asymmetric suspension of the portable ledge apparatus in a second mode.

FIGS. 23 to 25 show parts of an inflatable portable ledge apparatus 10.2 according to a third embodiment. Like parts have like numbers and function as the embodiment shown in FIGS. 1 to 20 with the addition of "0.2". Inflatable portable ledge apparatus 10.2 is substantially the same as inflatable portable ledge apparatus 10 shown in FIGS. 1 to 20 with the following exceptions.

As seen in FIG. 23, the inflatable portable ledge apparatus 10.2 includes a plurality of links, in this example a first link 31, a second link 33 coupled to the first link, a third link 35, and a fourth link 37 coupled to the third link. Each link comprises a loop-shaped strap in this example. In FIG. 23 the first link couples to the suspension straps 30*a*.2, 32*a*.2, and 34*a*.2 via loop 45, and the third link 35 couples to the suspension straps 30*b*.2, 32*b*.2, and 34*b*.2 via loop 47 according to one example. The carabiner 43.2 extends through and couples to loops 45 and 45 in FIG. 23.

The link configuration allows for asymmetric suspension of the portable ledge apparatus 10.2. This is seen in FIG. 24 where loop 45 is spaced-apart below loop 47 and carabiner 43.2, and the carabiner extends through and couples to second link 33.

This is also shown in FIG. 25 where loop 45 is further spaced-apart below loop 47 and carabiner 43.2. In this case, an additional carabiner 49 couples together fourth link 37 and second link 33.

Figure 27:
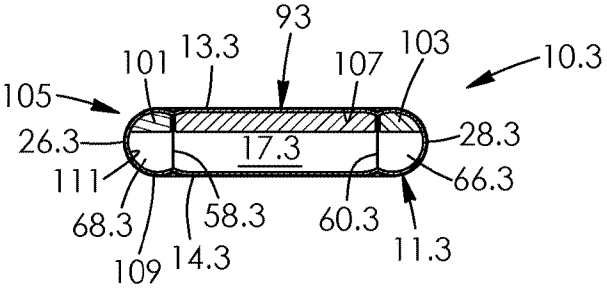
FIG. 27 is a sectional view taken along lines 27-27 of the portable ledge apparatus of FIG. 26.
Figure 26:
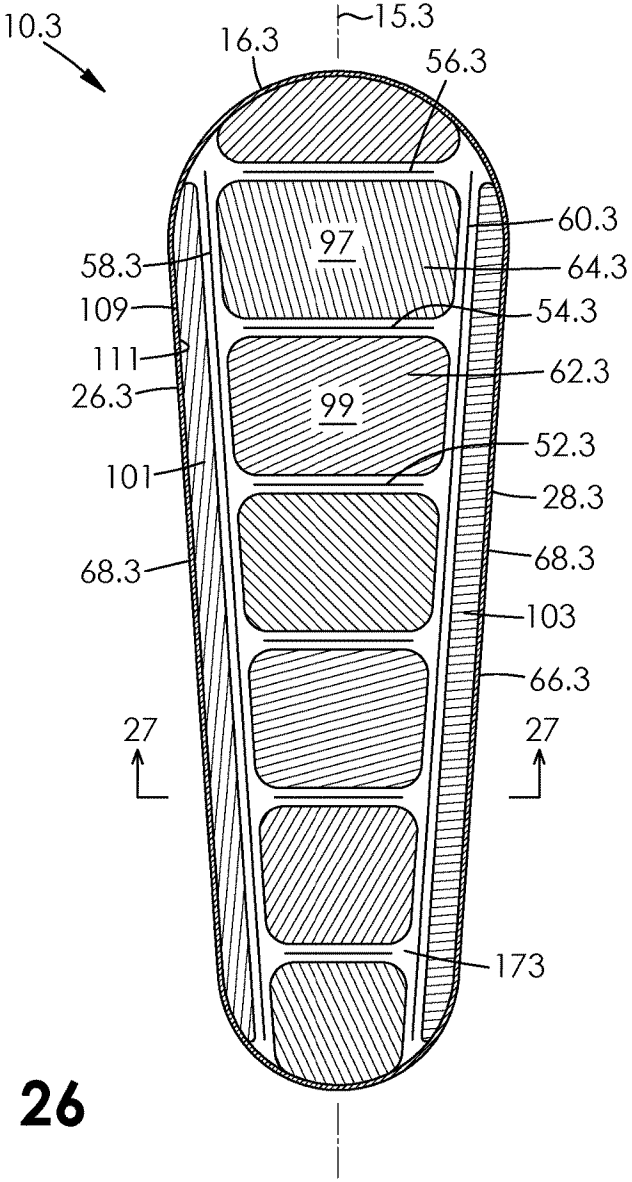
FIG. 26 is a sectional top plan view of an inflatable, portable ledge apparatus according to a fourth aspect.

FIGS. 26 to 27 show an inflatable portable ledge apparatus 10.3 according to a fourth embodiment. Like parts have like numbers and function as the embodiment shown in FIGS. 1 to 20 with the addition of "0.3". Inflatable portable ledge apparatus 10.3 is substantially the same as inflatable portable ledge apparatus 10 shown in FIGS. 1 to 20 with the following exceptions.

The interior 17.3 of the inflatable platform 12.3 in this embodiment is provided with insulation, in this example synthetic fiber insulation disposed within transverse and longitudinal sub-chambers of the inflatable platform. This is shown in FIG. 26 by insulation 97 and 99 positioned within transverse sub-chambers 62.3 and 64.3 and insulation 101 and 103 positioned within longitudinal sub-chambers 66.3 and 68.3.

As seen in FIG. 27, the insulation is positioned with an upper portion 105 of the inflatable platform 12.3 which contacts the person (not shown) lying thereon. The insulation is coupled to and in this example glued to the inner surface 107 of the top 13.3 of the inflatable platform 12.3.

Referring back to FIG. 26, the insulation 97, 99, 101 and 103 reduces convective heat loss. Also as seen in FIG. 26, the inflatable platform 12.3 includes a reflective member, in this example film 109 coupled to the interior surface 111 thereof in this example to reduce radiant heat loss. Alternatively, or in addition, the insulation 97, 99, 101 and 103 may comprise reflective fiber to reduce radiant heat loss. The insulation reduces convective heat loss, the reflective film and/or fiber reduces radiant heat loss, and the air spaces in the sub-chambers 62.3, 64.3, 66.3 and 68.3 reduce conductive heat loss. These three features working together achieve to maximize insulating result.

Figure 28:
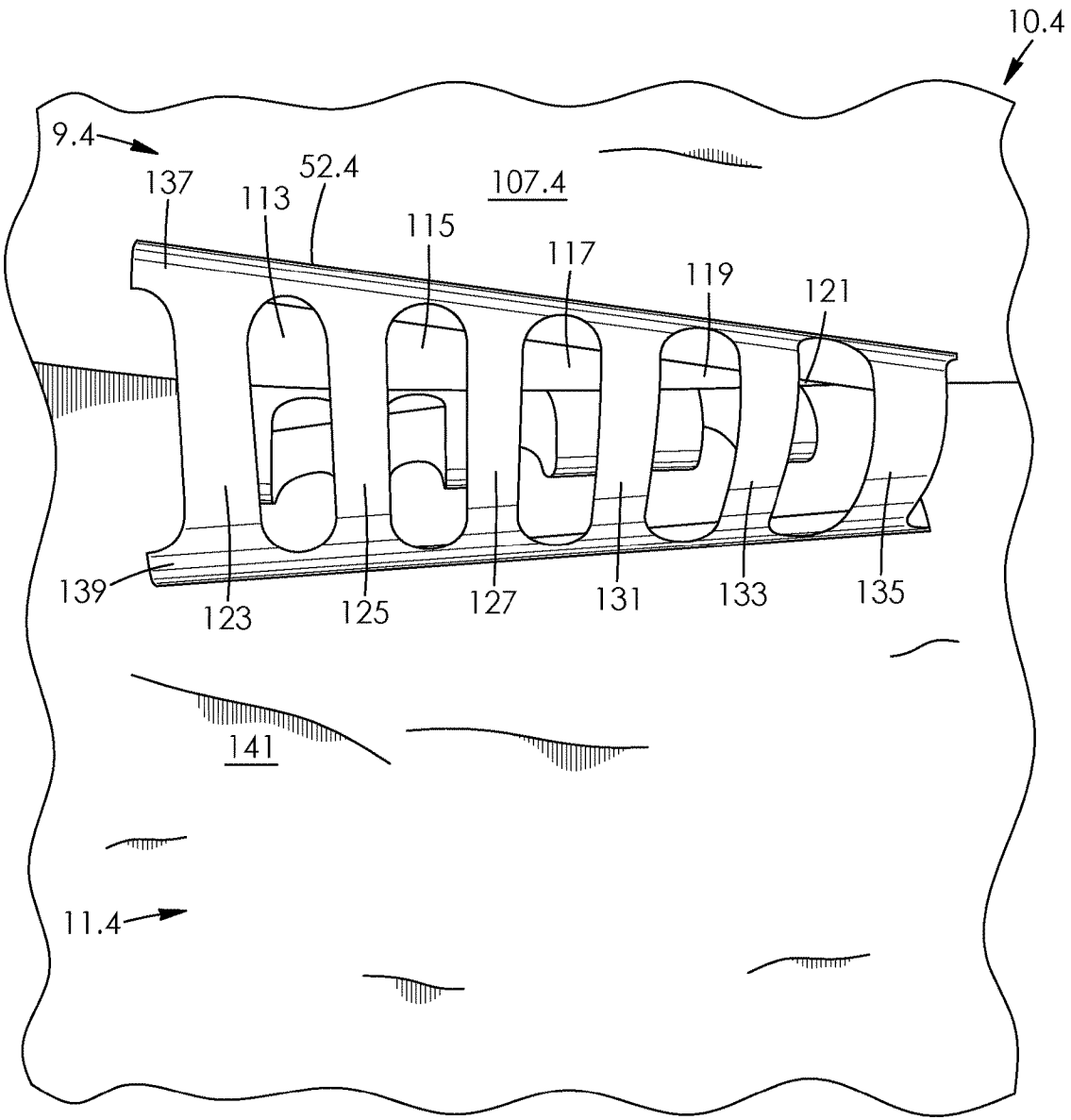
FIG. 28 is a perspective, fragmented view of the interior of an inflatable, portable ledge apparatus according to a fifth aspect.

FIG. 28 shows parts of an inflatable portable ledge apparatus 10.4 according to a fifth embodiment. Like parts have like numbers and function as the embodiment shown in FIGS. 1 to 20 with the addition of "0.4". Inflatable portable ledge apparatus 10.4 is substantially the same as inflatable portable ledge apparatus 10 shown in FIGS. 1 to 20 with the following exceptions.

In this embodiment each baffle 52.4 of the apparatus has one or more apertures extending therethrough, in this example a plurality of spaced-apart apertures 113, 115, 117, 119 and 121. Each of the apertures is elongate and obround in shape in this example. Each baffle comprises a first plurality of elongate strips, in this example vertically-extending strips 123, 125, 127, 129, 131, 133 and 135 between which respective said apertures extend. Each baffle 52.4 includes a second plurality of elongate strips, in this example horizontally-extending upper strip 137 and lower strip 139 between which the vertically-extending strips extend. The strips are integrally connected together and form an integrated whole in this example. Each upper strip 137 couples to the inner surface 107.4 of the top 9.4 of the inflatable platform 12.4 in this example. Each lower strip 139 couples to the inner surface 141 of the bottom 11.4 of the inflatable platform 12.4.

The baffles 52.4 so shaped are thus perforated, and this enables air to flow readily through the inflatable platform 12.4. The baffles so shaped also function to reduce the overall weight of the portable ledge apparatus 10.4.

ADDITIONAL DESCRIPTION

Examples of devices for portable ledge apparatuses, and height-adjustable assemblies thereof, have been described. The following clauses are offered as further description.

(1) A portable ledge apparatus comprising: an inflatable platform including a plurality of transverse baffles and a plurality of longitudinal baffles; and a plurality of suspension straps connected to the inflatable platform, wherein the suspension straps are connected the inflatable platform so that a load on the inflatable platform is distributed across the suspension straps when the portable ledge apparatus is anchored at a single point.

(2) The portable ledge apparatus of clause 1 wherein a first said longitudinal baffle is positioned adjacent to a first longitudinal side of the inflatable platform and a second said longitudinal baffle is positioned adjacent to a first longitudinal side of the inflatable platform.

(3) The portable ledge apparatus of clause 1 wherein the inflatable platform has a longitudinal axis, and wherein the transverse baffles extend between longitudinal sides of the inflatable platform and extend perpendicular to said longitudinal axis of the inflatable platform.

(4) The portable ledge apparatus of any one of clauses 1 to 3 wherein the inflatable platform has a first end and a second end, wherein the transverse baffles are spaced-apart at intervals from adjacent the first end of the inflatable platform to adjacent the second end of the inflatable platform, and wherein the longitudinal baffles extend between the first end of the inflatable platform and the second end of the inflatable platform.

(5) The portable ledge apparatus of any one of clauses 1 to 4 wherein the inflatable platform has a top and a bottom, and wherein the transverse baffles are disposed between and are enclosed by the longitudinal baffles, the top of the inflatable platform and the bottom of the inflatable platform.

(6) The portable ledge apparatus of any one of clauses 1 to 5 wherein the transverse baffles are spaced-apart from the longitudinal baffles, thereby enabling air to flow around the baffles when the inflatable platform is being inflated.

(7) The portable ledge apparatus of any one of clauses 1 to 6 wherein the baffles are positioned to align below a person lying on top of the inflatable platform.

(8) The portable ledge apparatus of clause 1 wherein the inflatable platform has a top, a bottom, and longitudinal sides extending between the top thereof and the bottom thereof, wherein the inflatable platform has a first longitudinally-extending sub-chamber formed by a first said longitudinal baffle, the top of the inflatable platform, the bottom of the inflatable platform and a first said longitudinal side of the inflatable platform, wherein the inflatable platform has a second longitudinally-extending sub-chamber formed by a second said longitudinal baffle, the top of the inflatable platform, the bottom of the inflatable platform and a second said longitudinal side of the inflatable platform, and wherein the inflatable platform has a plurality of transversely-extending sub-chambers each being formed by adjacent said transverse baffles, the top of the inflatable platform and the bottom of the inflatable platform.

(9) The portable ledge apparatus of any one of clauses 1 to 7 wherein the inflatable platform includes a plurality of transverse-extending sub-chambers, a plurality of longitudinally-extending sub-chambers, and insulation positioned within said sub-chambers.

(10) The portable ledge apparatus of any one of clauses 1 to 7 wherein the inflatable platform includes a plurality of sub-chambers with air spaces therein to inhibit conductive heat loss, wherein the inflatable platform includes insulation positioned with said sub-chambers to inhibit convective heat loss, and wherein the inflatable platform includes a reflective member to inhibit radiant heat loss.

(11) The portable ledge apparatus of any one of clauses 1 to 10 wherein each said baffle has one or more apertures extending therethrough.

(12) The portable ledge apparatus of any one of clauses 1 to 11 wherein each said baffle includes a plurality of elongate, vertically-extending strips between which respective apertures extend and wherein each said baffle includes a plurality of elongate, horizontally-extending strips between which the vertically-extending strips extend.

(13) The portable ledge apparatus of clause 12, wherein the strips are connected together and form an integrated whole.

(14) The portable ledge apparatus of any one of clauses 12 to 13, wherein an upper said horizontally-extending strip couples to an interior surface of the top of the inflatable platform, and wherein a lower said horizontally-extending strip couples to an interior surface of the bottom of the inflatable platform.

(15) The portable ledge apparatus of any one of clauses 1 to 14 further including a bottom strap.

(16) The portable ledge apparatus of clause 1 further including a bottom strap, the bottom strap extending transversely between opposite longitudinal sides of the inflatable platform.

(17) The portable ledge apparatus of any one of clauses 1 to 16 further including a wear patch.

(18) The portable ledge apparatus of any one of clauses 1 to 17 further including an adjustable strap formed from a braided cord, the adjustable strap having a first end portion and a second end portion, the first end portion of the adjustable strap being fed back through a hollow sub-portion of the braided cord and the first end portion of the adjustable strap terminating in an end-splice, and the second end portion of the adjustable strap terminating in an eye-splice.

(19) The portable ledge apparatus of any one of clauses 1 to 18 further including a connector coupled to a suspension web of at least one of the suspension straps to allow the portable ledge apparatus to be coupled to another portable ledge apparatus.

(20) The portable ledge apparatus of any one of clauses 1 to 19 further including a rainfly having a wedge of fabric to allow the rainfly to be moved to an extended configuration.

(21) The portable ledge apparatus of any one of clauses 1 to 20 further including a plurality of links coupled at least one of the suspension straps to allow asymmetric suspension of the portable ledge apparatus.

(22) A portable ledge apparatus comprising: an inflatable platform including a plurality of baffles; and a plurality of suspension straps connected to the inflatable platform, the suspension straps connecting to the inflatable platform so that a load on the inflatable platform is distributed across all of the suspension straps when the portable ledge apparatus is anchored at a single point.

(23) A portable ledge apparatus comprising: an inflatable platform having a top, a bottom, and first and second longitudinal sides extending between the top thereof and the bottom thereof; a plurality of baffles coupled to and extending between the top and the bottom of the inflatable platform, including a first longitudinally-extending said baffle extending parallel with the first longitudinal side of the inflatable platform, a second longitudinally-extending said baffle extending parallel with the second longitudinal side of the inflatable platform, and additional said baffles extending between the longitudinal sides of the inflatable platform; and one or more suspension members connected to the inflatable platform.

(24) The portable ledge apparatus of clause 23, wherein the suspension members connect to the inflatable platform so that a load on the inflatable platform is distributed across the suspension members when the portable ledge apparatus is anchored at a single point.

(25) The portable ledge apparatus of clause 24 wherein the suspension members are suspension straps and wherein the load is distributed across all of the suspension straps when the portable ledge apparatus is anchored at said single point.

(26) A height-adjustment assembly for a suspended load, the height-adjustment assembly comprising: a first end portion of rope; a second end portion of rope coupled to the first end portion of rope, the second end portion of rope including a hollow sub-portion and a first anchor-point loop connectable to the suspended load; and a second loop formed by extending the first end portion of rope through the hollow sub-portion of the second end portion of rope, the second loop being connectable to an elevated coupling member, with the suspended load causing the hollow sub-portion to constrict in cross-section and frictionally engage the first end portion of rope, whereby pulling on the first end portion of rope expands the hollow sub-portion, enabling the first end portion of rope to be further pulled through the hollow sub-portion, thereby reducing the size of the second loop and raising the suspended load.

(27) The assembly of clause 26, wherein the second loop has a first vertically-extending piece of cord comprising the hollow sub-portion of the second end portion of rope, wherein the second loop has a second vertically-extending piece of cord coupled to the first vertically-extending piece of cord, with the suspended load causing a downward force on both pieces of cord, resulting in the hollow sub-portion of the second end portion to extend in length and constrict in cross-section, and frictionally engaging the first end portion of rope.

(28) The assembly of clause 26, wherein the second loop has a first vertically-extending piece of cord comprising the hollow sub-portion of the second end portion of rope, wherein the second loop has a second vertically-extending piece of cord coupled to the first vertically-extending piece of cord, whereby pulling downwards on the first vertically-extending piece of cord causes the hollow sub-portion of the second end portion to constrict in cross-section and frictionally engage the first end portion of rope, and pulling downwards on the second vertically-extending piece of cord causes the hollow sub-portion of the second end portion of rope to expand in cross-section and enable the first end portion of rope to selectively extend therethrough, with the second loop thus expanding in size and the suspended load selectively lowering thereby.

(29) The assembly of any one of clauses 26 to 28 wherein the second end portion of rope terminates in an eye-splice.

(30) The assembly of any one of clauses 26 to 29 wherein the first end portion of rope terminates in an end-splice.

(31) The assembly of clause 30 wherein the first end portion of rope includes a knot adjacent to the end splice.

(32) The assembly of any one of clauses 26 to 31 wherein the rope comprises braided cord.

(33) The assembly of any one of clauses 26 to 32, wherein the first loop comprises a first anchor point and wherein the second loop comprises a second anchor point.

(34) The assembly of any one of clauses 26 to 33, wherein the assembly comprises an adjustable strap and wherein the suspended load is a portable ledge apparatus.

(35) The assembly of clause of any one of clauses 26 to 34, where the coupling member is a carabiner.

It will also be understood by a person skilled in the art that many of the details provided above are by way of example only, and are not intended to limit the scope of the invention which is to be determined with reference to the following claims.

What is claimed is:

1. A portable ledge apparatus comprising:

an inflatable platform including a plurality of baffles configured to support a person lying down thereon; and a plurality of suspension straps connected to the inflatable platform, wherein each of the suspension straps is connected to the inflatable platform via a discrete suspension web such that a load on the inflatable platform is distributed across the suspension straps when the portable ledge apparatus is anchored at a single point.

2. The portable ledge apparatus as claimed in claim 1 wherein the baffles include a plurality of transverse said baffles and a plurality of longitudinal said baffles.

3. The portable ledge apparatus as claimed in claim 1 wherein the baffles include a first longitudinal said baffle positioned adjacent to a first longitudinal side of the inflatable platform and wherein the baffles include a second longitudinal said baffle positioned adjacent to a second longitudinal side of the inflatable platform.

4. The portable ledge apparatus as claimed in claim 1 wherein the inflatable platform includes a plurality of transverse-extending sub-chambers, a plurality of longitudinally-extending sub-chambers, and insulation positioned within said sub-chambers.

5. The portable ledge apparatus as claimed in claim 1 wherein the inflatable platform includes a plurality of sub-chambers with air spaces therein to inhibit conductive heat loss, wherein the inflatable platform includes insulation positioned with said sub-chambers to inhibit convective heat loss, and wherein the inflatable platform includes a reflective member to inhibit radiant heat loss.

6. The portable ledge apparatus as claimed in claim 1 wherein each said baffle has one or more apertures extending therethrough.

7. The portable ledge apparatus as claimed in claim 1 wherein each said baffle includes a plurality of elongate, vertically-extending strips between which respective apertures extend and wherein each said baffle includes a plurality of elongate, horizontally-extending strips between which the vertically-extending strips extend.

8. The portable ledge apparatus as claimed in claim 1 further including a bottom strap which extends transversely between opposite longitudinal sides of the inflatable platform.

9. The portable ledge apparatus as claimed in claim 1 further including an adjustable strap formed from a braided cord, the adjustable strap having a first end portion and a second end portion, the first end portion of the adjustable strap being fed back through a hollow sub-portion of the braided cord and the first end portion of the adjustable strap terminating in an end-splice, and the second end portion of the adjustable strap terminating in an eye-splice.

10. The portable ledge apparatus as claimed in claim 1 further including a rainfly having a wedge of fabric to allow the rainfly to be moved to an extended configuration.

11. The portable ledge apparatus as claimed in claim 1 further including a plurality of links coupled to at least one of the suspension straps to allow asymmetric suspension of the portable ledge apparatus.

12. The portable ledge apparatus as claimed in claim 1 wherein each said suspension web is triangular.

13. The portable ledge apparatus as claimed in claim 1, wherein the suspension webs are connected to or formed from a seam allowance of the inflatable platform.

14. The portable ledge apparatus as claimed in claim 1, wherein the portable ledge apparatus includes a first pair of said suspension webs disposed near a first end of the inflatable platform, a second pair of said suspension webs disposed near a second end of the inflatable platform, and a third pair of said suspension webs disposed respectively between the first pair of said suspension webs and the second pair of said suspension webs, with respective ones of the corresponding said suspension webs being disposed along and coupling to opposite longitudinal sides of the inflatable platform.

15. The portable ledge apparatus as claimed in claim 14 wherein the third pair of said suspension webs are larger than the first pair of said suspension webs and wherein the third pair of said suspension webs are larger than the second pair of said suspension webs.

16. The portable ledge apparatus as claimed in claim 1 further including a carabiner to which the suspension straps couple.

17. The portable ledge apparatus as claimed in claim 1, wherein each of the suspension webs is formed from the inflatable platform.

18. The portable ledge apparatus as claimed in claim 1, wherein each of the suspension webs includes a pair of side portions which couple together via the respective suspension strap thereof and which extend downwards therefrom in an inverse V-shape.

19. A portable ledge apparatus comprising:

an inflatable platform including a plurality of baffles;

a plurality of suspension straps connected to the inflatable platform, wherein the suspension straps are connected to the inflatable platform so that a load on the inflatable platform is distributed across the suspension straps when the portable ledge apparatus is anchored at a single point; and a wear patch coupled to the inflatable platform.

20. A portable ledge apparatus comprising:

an inflatable platform having a first end and a second end spaced-apart from the first end thereof, the inflatable platform having a first longitudinal side and a second longitudinal side spaced-apart from the first longitudinal side thereof, the longitudinal sides of the inflatable platform extending between the ends of the inflatable platform, and the inflatable platform having a top and a bottom spaced-apart from the top thereof;

a plurality of suspension straps connected to the inflatable platform, wherein each of the suspension straps is connected to the inflatable platform via a discrete suspension web such that a load on the inflatable platform is distributed across the suspension straps when the portable ledge apparatus is anchored at a single point;

a first longitudinal baffle positioned adjacent to the first longitudinal side of the inflatable platform, the first longitudinal baffle extending between the first end of the inflatable platform and the second end of the inflatable platform, and the first longitudinal baffle extending from the top of the inflatable platform to the bottom of the inflatable platform;

a second longitudinal baffle positioned adjacent to the second longitudinal side of the inflatable platform, the second longitudinal baffle extending between the first end of the inflatable platform and the second end of the inflatable platform, and the second longitudinal baffle extending from the top of the inflatable platform to the bottom of the inflatable platform; and a plurality of transverse baffles that are spaced-apart at intervals from adjacent the first end of the inflatable platform to adjacent the second end of the inflatable platform, the plurality of transverse baffles extending from adjacent the first longitudinal baffle to adjacent the second longitudinal baffle, and the plurality of tranverse baffles extending from the top of the inflatable platform to the bottom of the inflatable platform.

* * * * *